US009961958B1

(12) United States Patent
Granger et al.

(10) Patent No.: US 9,961,958 B1
(45) Date of Patent: May 8, 2018

(54) CONTOURED SUPPORT SHOE INSOLE

(71) Applicant: Implus Footcare, LLC, Durham, NC (US)

(72) Inventors: David Bradley Granger, Lorena, TX (US); Jacob Martinez, Temple, TX (US)

(73) Assignee: Implus Footcare, LLC, Durham, NC (US)

( * ) Notice: Subject to any disclaimer, the term of this patent is extended or adjusted under 35 U.S.C. 154(b) by 0 days. days.

(21) Appl. No.: 15/567,450

(22) PCT Filed: May 25, 2016

(86) PCT No.: PCT/US2016/034196

§ 371 (c)(1),
(2) Date: Oct. 18, 2017

(87) PCT Pub. No.: WO2016/191505

PCT Pub. Date: Dec. 1, 2016

Related U.S. Application Data

(60) Provisional application No. 62/167,771, filed on May 28, 2015, provisional application No. 62/182,060,
(Continued)

(51) Int. Cl.
*A43B 13/38* (2006.01)
*A43B 7/14* (2006.01)
(Continued)

(52) U.S. Cl.
CPC ..... *A43B 7/144* (2013.01); *A43B 3/0063* (2013.01); *A43B 7/141* (2013.01); *A43B 7/142* (2013.01);
(Continued)

(58) Field of Classification Search
CPC ..... A43B 17/00; A43B 17/02; A43B 7/142; A43B 7/143; A43B 7/144; A43B 7/141; A43B 7/1445
(Continued)

(56) References Cited

U.S. PATENT DOCUMENTS 333,595 A 1/1886 Butterfield
360,127 A 3/1887 Wallis
(Continued)

FOREIGN PATENT DOCUMENTS

DE 2603716 12/1976
EP 0774219 12/1997
(Continued)

OTHER PUBLICATIONS

PCT, International Search Report & Written Opinion of the International Searching Authority for International Patent Application No. PCT/US2016/034196, dated Sep. 7, 2016.
(Continued)

*Primary Examiner* — Ted Kavanaugh
(74) *Attorney, Agent, or Firm* — Hemingway & Hansen, LLP; D. Scott Hemingway

(57) ABSTRACT

An insole having a top sheet and a base layer with three pieces that include a base layer, a forefoot pad and a midfoot-to-heel support cushion. The mid-foot/heel surface has a raised medial arch and longitudinal curvilinear indentations, a flattened mid-foot area with a metatarsal mid-foot tear-drop raised area, and a surrounding the heel pod that cups the exterior back by a heel cup. A heel pad opening goes through the entirety of the thickness of base layer of the insole body and a heel pad is affixed to the bottom surface of the base layer. There is also a supersoft heel dome and a metatarsal raised dome on the top (foot contact) surface of
(Continued)

the insole which would be directly above the heel pod and the metatarsal midfoot area, respectively.

55 Claims, 6 Drawing Sheets

Related U.S. Application Data filed on Jun. 19, 2015, provisional application No. 62/234,212, filed on Sep. 29, 2015.

(51) Int. Cl.
*A43B 17/02* (2006.01)
*A43B 3/00* (2006.01)

(52) U.S. Cl.
CPC ..... *A43B 7/143* (2013.01); *A43B 7/145* (2013.01); *A43B 7/148* (2013.01); *A43B 7/1445* (2013.01); *A43B 17/02* (2013.01); *A43B 17/026* (2013.01)

(58) Field of Classification Search
USPC ..... 36/43, 44
See application file for complete search history.

(56) References Cited

U.S. PATENT DOCUMENTS 892,360 A 6/1908 Burns
1,559,324 A 10/1925 Jensen
1,688,642 A 10/1928 Mattison
1,693,122 A 11/1928 Schwartz
1,718,906 A 6/1929 Hurley
1,811,641 A 6/1931 Marcelle
1,861,969 A 6/1932 Leighton, Jr.
1,920,112 A 7/1933 Shaft
1,945,780 A 2/1934 Johnson
2,031,510 A 2/1936 Stewart et al.
2,045,844 A 6/1936 Everston
2,055,574 A 9/1936 Hartl
2,090,881 A 8/1937 Wilson
2,207,437 A 7/1940 Marks et al.
2,224,590 A 12/1940 Boivin
2,224,642 A 12/1940 Burns
2,284,947 A 6/1942 Clifford
2,302,706 A 11/1942 Margolin
2,347,207 A 4/1944 Margolin
2,408,564 A 10/1946 Lea
D149,889 S 6/1948 Laybolt
2,502,774 A 4/1950 Alianiello
2,553,616 A 5/1951 Walls
2,790,254 A 4/1957 Burns
2,827,050 A 3/1958 Fisher
2,857,689 A 10/1958 Van Ostrom et al.
2,985,971 A 5/1961 Murawski
3,084,695 A 4/1963 O'Donnell
3,154,867 A 11/1964 Strope
3,475,836 A 11/1969 Brahm
3,992,801 A 11/1976 McDiarmid et al.
D243,642 S 3/1977 Voorhees
4,020,570 A 5/1977 Shames
4,033,054 A 7/1977 Fukuoka
D246,486 S 11/1977 Nickel
4,071,963 A 2/1978 Fukuoka
4,108,928 A 8/1978 Swan, Jr.
4,123,855 A 11/1978 Thedford
4,139,337 A 2/1979 David et al.
4,150,455 A 4/1979 Fukuoka
4,179,826 A 12/1979 Davidson
4,215,492 A 8/1980 Sandmeier
4,219,945 A 9/1980 Rudy
4,223,457 A 9/1980 Borgeas
4,229,546 A 10/1980 Swan, Jr.
4,237,626 A 12/1980 Brown
4,263,728 A 4/1981 Frecentese
4,309,831 A 1/1982 Pritt
4,316,332 A 2/1982 Giese et al.
4,325,380 A 4/1982 Malkin
4,346,205 A 8/1982 Hiles
4,346,525 A 8/1982 Larsen et al.
4,364,188 A 12/1982 Turner et al.
4,408,402 A 10/1983 Looney
4,413,429 A 11/1983 Power
4,453,322 A 6/1984 Marsh
4,541,184 A 9/1985 Leighton
4,541,186 A 9/1985 Mulvihill
4,546,555 A 10/1985 Spademan
4,557,060 A 12/1985 Kawashima
4,571,857 A 2/1986 Castellanos
4,581,187 A 4/1986 Sullivan et al.
4,584,782 A 4/1986 Thatcher
4,616,430 A 10/1986 McQuiggin
4,619,056 A 10/1986 Lin et al.
4,627,178 A 12/1986 Sullivan et al.
4,627,179 A 12/1986 McElroy
4,633,597 A 1/1987 Shiang
4,633,598 A 1/1987 Moronaga et al.
4,633,877 A 1/1987 Pendergast
D288,383 S 2/1987 Autry
4,674,204 A 6/1987 Sullivan et al.
4,694,589 A 9/1987 Sullivan et al.
4,694,831 A 9/1987 Seltzer
4,729,179 A 3/1988 Quist, Jr.
D295,690 S 5/1988 Finn
D299,583 S 1/1989 Tong et al.
4,800,657 A 1/1989 Brown
4,808,469 A 2/1989 Hiles
4,813,160 A 3/1989 Kuznetz
4,860,463 A 8/1989 Pin
4,864,736 A 9/1989 Bierk
4,864,740 A 9/1989 Oakley
4,876,758 A 10/1989 Rolloff et al.
4,887,368 A 12/1989 Latzke
4,888,841 A 12/1989 Cumberland
4,888,887 A 12/1989 Solow
4,928,404 A 5/1990 Scheuermann
D311,269 S 10/1990 Graham et al.
4,974,342 A 12/1990 Nakamura
5,010,661 A 4/1991 Chu
5,014,706 A 5/1991 Philipp
5,025,573 A 6/1991 Giese et al.
5,025,575 A 6/1991 Lakic
5,027,461 A 7/1991 Cumberland
5,035,068 A 7/1991 Biasi
D319,919 S 9/1991 Niarhos
D324,761 S 3/1992 Soo-Kwan
5,092,060 A 3/1992 Frachey et al.
5,138,775 A 4/1992 Chu
5,155,927 A 10/1992 Bates et al.
5,175,946 A 1/1993 Tsai
5,184,409 A 2/1993 Brown
5,197,207 A 3/1993 Shorten
5,201,125 A 4/1993 Shorten
D336,718 S 6/1993 Schroer, Jr.
5,224,277 A 7/1993 Sang Do
5,233,767 A 8/1993 Kramer
D342,374 S 12/1993 Wang
5,282,324 A 2/1994 Cheng
D346,480 S 5/1994 Davidson
D348,146 S 6/1994 Nakano
D349,393 S 8/1994 Mishan
D350,432 S 9/1994 Saez
D350,848 S 9/1994 Tzenos
5,363,570 A 11/1994 Allen et al.
5,367,791 A 11/1994 Gross et al.
D353,710 S 12/1994 Brazzell
5,369,896 A 12/1994 Frachey et al.
5,375,346 A 12/1994 Cole et al.
5,400,528 A 3/1995 Skinner et al.
5,400,526 A 4/1995 Sessa
5,408,761 A 4/1995 Gazzano
5,430,960 A 7/1995 Richardson
5,438,768 A 8/1995 Bauerfeind

(56) References Cited

U.S. PATENT DOCUMENTS 5,443,529 A 8/1995 Phillips
5,467,536 A 11/1995 Ramer et al.
5,493,791 A 2/1996 Kramer
D367,953 S 3/1996 King
5,509,938 A 4/1996 Phillips
5,524,364 A 6/1996 Cole et al.
5,545,463 A 8/1996 Schmidt et al.
D374,549 S 10/1996 McDonald
5,615,496 A 4/1997 Sharpstein
5,619,809 A 4/1997 Sessa
5,640,779 A 6/1997 Rolloff et al.
D380,290 S 7/1997 Nakagawa
D383,894 S 9/1997 Snyder et al.
5,669,162 A 9/1997 Dyer
D384,797 S 10/1997 Nakagawa
5,675,914 A 10/1997 Cintron
5,678,328 A 10/1997 Schmidt et al.
5,685,094 A 11/1997 Lin
D388,947 S 1/1998 Sessa
D389,296 S 1/1998 Sessa
D389,996 S 2/1998 Sessa
5,714,098 A 2/1998 Potter
5,722,186 A 3/1998 Brown
5,732,481 A 3/1998 Farhad
5,768,801 A 6/1998 Huff
5,771,606 A 6/1998 Lltchfield et al.
5,775,005 A 7/1998 McClelland
D396,948 S 8/1998 Moore et al.
5,802,737 A 9/1998 Beppu
D399,042 S 10/1998 Strawser et al.
5,815,949 A 10/1998 Sessa
5,845,418 A 12/1998 Chi
5,846,063 A 12/1998 Lakic
5,852,885 A 12/1998 Ferniani
D403,847 S 1/1999 Blythe
5,879,725 A 3/1999 Potter
D411,759 S 7/1999 Byrd
D418,666 S 1/2000 Brown
D420,210 S 2/2000 Allen
D420,788 S 2/2000 Kitagawa
6,029,372 A 2/2000 Pan
D423,765 S 5/2000 Autry
D425,690 S 5/2000 Bray et al.
D426,118 S 6/2000 Thomas
6,070,342 A 6/2000 Brown
6,079,123 A 6/2000 Clark
6,082,023 A 7/2000 Dalton
D428,689 S 8/2000 Guiotto et al.
D429,063 S 8/2000 Rose
6,105,283 A 8/2000 Park
D432,769 S 10/2000 Yung et al.
6,151,801 A 11/2000 Frederiksen et al.
6,176,025 B1 1/2001 Patterson et al.
D441,947 S 5/2001 Escobar et al.
6,233,847 B1 5/2001 Brown
6,266,897 B1 7/2001 Seydel et al.
D448,542 S 10/2001 Bryant
D448,850 S 10/2001 Fabricant
6,301,805 B1 10/2001 Howlett et al.
D456,128 S 4/2002 Evans et al.
D460,854 S 7/2002 Hung
6,425,195 B1 7/2002 Donzis
6,453,578 B1 9/2002 Yung et al.
D465,079 S 11/2002 Merceron
6,481,120 B1 11/2002 Xia et al.
6,497,057 B1 12/2002 Lee et al.
6,502,330 B1 1/2003 David et al.
6,510,626 B1 1/2003 Greenawalt
6,519,874 B1 2/2003 Dean
D471,001 S 3/2003 Beck
6,536,137 B1 3/2003 Celia
6,553,690 B2 4/2003 Di Girolamo
D474,331 S 5/2003 Dean
D474,588 S 5/2003 Dean
D474,881 S 5/2003 Su
D475,844 S 6/2003 Reynolds et al.
6,581,303 B1 6/2003 Tuan
6,598,319 B2 7/2003 Hardt
6,618,960 B2 9/2003 Brown
6,631,568 B2 10/2003 Howlett et al.
D485,425 S 1/2004 Polifroni
D485,426 S 1/2004 Di Girolamo
6,671,979 B2 1/2004 Cardarelli
6,684,532 B2 2/2004 Greene et al.
D489,520 S 5/2004 Matis et al.
D495,123 S 8/2004 Wakatake
D497,473 S 10/2004 Martinez
D497,708 S 11/2004 Granger et al.
6,817,115 B2 11/2004 Polifioni
D500,914 S 1/2005 Ammon
6,880,266 B2 4/2005 Schoenborn et al.
6,915,598 B2 7/2005 Grisoni et al.
6,959,505 B2 11/2005 Poe
6,967,044 B1 11/2005 O'Brien
D515,292 S 2/2006 Granger et al.
7,082,702 B2 8/2006 Cretinon
7,082,704 B2 8/2006 Throneburg
7,107,705 B2 9/2006 Dalton et al.
D529,691 S 10/2006 Earle
D543,685 S 6/2007 Andersen et al.
7,284,342 B2 10/2007 Avent et al.
7,316,081 B1 1/2008 Cheng
D563,649 S 3/2008 Andersen et al.
D576,391 S 9/2008 Contreras
D576,394 S 9/2008 Heller
7,437,836 B2 10/2008 Kim
D584,885 S 1/2009 Contreras
7,484,319 B2 2/2009 Cheskin et al.
D592,386 S 5/2009 Baker et al.
D593,742 S 6/2009 Issler
D594,640 S 6/2009 McMillan
D596,833 S 7/2009 Dominquez et al.
7,555,849 B2 7/2009 Canvin
D602,238 S 10/2009 Avent et al.
7,610,696 B2 11/2009 Davis
7,665,169 B2 2/2010 Cheskin et al.
D611,237 S 3/2010 Torrance et al.
7,712,229 B2 5/2010 Yang
7,721,467 B2 5/2010 Cheskin et al.
D617,086 S 6/2010 Avent et al.
D617,087 S 6/2010 Avent et al.
D627,958 S 11/2010 Cheskin et al.
D628,779 S 12/2010 Martinez et al.
D634,920 S 3/2011 Martinez et al.
D634,924 S 3/2011 Cheskin et al.
7,900,380 B2 3/2011 Rich
7,908,768 B2 3/2011 Cheskin et al.
8,136,266 B2 3/2012 McCarron
D656,716 S 4/2012 Eades
8,186,081 B2 5/2012 Wilson, III et al.
D663,511 S 7/2012 Martinez et al.
8,241,450 B2 8/2012 Hensley et al.
8,250,784 B2 8/2012 Cheskin et al.
8,296,969 B2 10/2012 Granger et al.
8,424,222 B2 4/2013 Sulak et al.
D681,321 S 5/2013 Martinez et al.
8,745,894 B2 6/2014 Cheskin et al.
D723,786 S 3/2015 Martinez et al.
2001/0000369 A1 4/2001 Snyder et al.
2001/0045028 A1 11/2001 Crane et al.
2002/0050080 A1 5/2002 Vasyli
2002/0083618 A1* 7/2002 Erickson ..... A43B 3/26 36/44
2002/0092203 A1 7/2002 Hardt
2002/0116840 A1 8/2002 Kraft
2003/0009915 A1 1/2003 Bacon
2003/0024134 A1 2/2003 Howlett et al.
2003/0070321 A1 4/2003 Davis et al.
2003/0093920 A1 5/2003 Greene et al.
2003/0121180 A1 7/2003 Poe
2003/0136025 A1 7/2003 Galbraith et al.
2003/0150134 A1 8/2003 Hardt
2004/0020075 A1 2/2004 Garneau
2004/0025374 A1 2/2004 Basso

(56) References Cited

U.S. PATENT DOCUMENTS

| | | | | |
|---|---|---|---|---|
| 2004/0118017 | A1 | 6/2004 | Dalton et al. | |
| 2004/0181971 | A1 | 9/2004 | Turkbas et al. | |
| 2004/0194344 | A1 | 10/2004 | Tadin | |
| 2005/0138847 | A1 | 6/2005 | Blackburn et al. | |
| 2005/0166425 | A1 | 8/2005 | Seiter | |
| 2005/0262736 | A1 | 12/2005 | Peoples | |
| 2006/0010717 | A1 | 1/2006 | Finkelstein | |
| 2006/0016099 | A1 | 1/2006 | Marco et al. | |
| 2006/0026779 | A1 | 2/2006 | Berg et al. | |
| 2006/0026865 | A1 | 2/2006 | Grisoni et al. | |
| 2006/0096124 | A1 | 5/2006 | Moseley | |
| 2006/0123664 | A1 | 6/2006 | Boyd et al. | |
| 2006/0130367 | A1 | 6/2006 | Liu | |
| 2006/0137216 | A1 | 6/2006 | Ahlbaumer | |
| 2006/0168846 | A1 | 8/2006 | Juan | |
| 2006/0230643 | A1 | 10/2006 | Affleck | |
| 2006/0254088 | A1 | 10/2006 | McCormick | |
| 2006/0283043 | A1 | 12/2006 | Lamstein | |
| 2007/0022630 | A1 | 2/2007 | Lundy, Jr. et al. | |
| 2007/0033834 | A1* | 2/2007 | Cheskin | A43B 7/141 36/44 |
| 2007/0039209 | A1 | 2/2007 | White | |
| 2007/0084084 | A1 | 4/2007 | Rich | |
| 2007/0245592 | A1 | 10/2007 | Yamaguchi et al. | |
| 2007/0261268 | A1 | 11/2007 | Nguyen | |
| 2008/0028637 | A1 | 2/2008 | Benfatti | |
| 2008/0110060 | A1 | 5/2008 | Ritter | |
| 2008/0110064 | A1 | 5/2008 | Liu | |
| 2008/0271340 | A1 | 11/2008 | Grisoni et al. | |
| 2008/0295358 | A1 | 12/2008 | Lin et al. | |
| 2009/0025254 | A1 | 1/2009 | Smith | |
| 2009/0049712 | A1* | 2/2009 | Steszyn | A43B 7/142 36/91 |
| 2009/0100722 | A1 | 4/2009 | Hoffer et al. | |
| 2009/0151194 | A1 | 6/2009 | Cheskin et al. | |
| 2009/0165334 | A1 | 7/2009 | Kantro et al. | |
| 2009/0249650 | A1 | 10/2009 | Sarantakos | |
| 2010/0015869 | A1 | 1/2010 | Hartmann et al. | |
| 2010/0083534 | A1 | 4/2010 | Howlett | |
| 2010/0095552 | A1 | 4/2010 | Cheskin et al. | |
| 2010/0126044 | A1 | 5/2010 | Davis | |
| 2010/0170116 | A1 | 7/2010 | Shim | |
| 2010/0205831 | A1 | 8/2010 | Cheskin et al. | |
| 2010/0212187 | A1 | 8/2010 | Jones | |
| 2010/0218398 | A1 | 9/2010 | Reinhardt et al. | |
| 2010/0218399 | A1 | 9/2010 | Jeong | |
| 2010/0251577 | A1 | 10/2010 | Yamada | |
| 2010/0269371 | A1* | 10/2010 | Gray | A43B 7/141 36/43 |
| 2011/0041360 | A1 | 2/2011 | Torrance | |
| 2011/0072685 | A1 | 3/2011 | Gutowsky, Jr. et al. | |
| 2011/0131835 | A1 | 6/2011 | Cheskin | |
| 2011/0162234 | A1 | 7/2011 | Dean | |
| 2011/0209360 | A1 | 9/2011 | Baker et al. | |
| 2011/0219642 | A1 | 9/2011 | Sulak et al. | |
| 2011/0232129 | A1 | 9/2011 | Roberts et al. | |
| 2011/0252665 | A1 | 10/2011 | Tsai | |
| 2011/0252671 | A1 | 10/2011 | Maron et al. | |
| 2011/0302805 | A1* | 12/2011 | Vito | A43B 7/142 36/44 |
| 2012/0023776 | A1 | 2/2012 | Skaja | |
| 2012/0090197 | A1 | 4/2012 | Wyner et al. | |
| 2012/0192452 | A1 | 8/2012 | Lewis et al. | |
| 2012/0272546 | A1 | 11/2012 | Tsai | |
| 2013/0008050 | A1 | 1/2013 | Marc | |
| 2013/0025156 | A1* | 1/2013 | Martinez | A43B 7/141 36/43 |
| 2013/0104419 | A1 | 5/2013 | Horesh et al. | |
| 2013/0160331 | A1 | 6/2013 | Burke | |
| 2014/0366399 | A1* | 12/2014 | Wakeland | A43B 13/386 36/44 |
| 2015/0000158 | A1* | 1/2015 | Wang | A43B 7/142 36/43 |

FOREIGN PATENT DOCUMENTS

| | | |
|---|---|---|
| KR | 20-19930024801 | 5/1992 |
| KR | 20-0312671 | 5/2003 |
| KR | 20-0427687 | 4/2006 |
| KR | 10-0641278 | 10/2006 |
| KR | 10-0736813 | 7/2007 |
| KR | 10-0780086 | 11/2007 |
| KR | 10-20090059886 | 6/2009 |
| KR | 10-0960562 | 6/2010 |
| KR | 10-1006923 | 1/2011 |
| KR | 10-1314656 | 10/2013 |
| KR | 10-1472734 | 12/2014 |
| WO | WO 2004060095 | 7/2004 |
| WO | WO 2006035469 | 4/2006 |
| WO | WO 2006090398 | 8/2006 |
| WO | WO 2007021328 | 2/2007 |
| WO | WO 2007056101 | 5/2007 |
| WO | WO 200815195 | 12/2008 |
| WO | WO 2009068298 | 6/2009 |
| WO | WO 2009126111 | 10/2009 |
| WO | WO 2009136685 | 11/2009 |
| WO | WO 2010124631 | 4/2010 |
| WO | WO 2011108011 | 9/2011 |
| WO | WO 2014036176 | 3/2014 |
| WO | WO 2014201423 | 12/2014 |
| WO | WO 2015038737 | 3/2015 |

OTHER PUBLICATIONS

[Online] [retrieved on Jan. 22, 2013] [retrieved from Foot Science Limited website] (pdf) http://www.footscience.com/products_foot.hmtl.

[Online] [retrieved on Jan. 22 ,2013] [retrieved from geldoctor website] (pdf) http://www.geldoctor.com/flosole.html.

[Online] [retrieved on Jan. 22, 2013] [retrieved from Gerbing's website] (pdf) http://www.gerbing.com/Products/insoles.php.

[Online] [retrieved on Jan. 22, 2013] [retrieved from Heat Factory website] (pdf) http://www.heatfactory.com/english/product.pht?cat=3&id.

[Online] [retrieved on Jan. 22, 2013] [retrieved from Dr. Rosenberg's Foot Products website] (pdf) http://www.instantarches.com/cool-soles.shtml.

[Online] [retrieved on Jan. 22, 2013] [retrieved from Mean and Green website]web page] (pdf) http://www.meanandgreen.com/army/-Thermal-Foil_insoles/2660/2303.html.

[Online] [retrieved on Jan. 22, 2013] [retrieved from Superfeet website] (pef) http://www.superfeet.com/products/REDHot.aspx.

[Online] [retrieved on Jan. 22, 2013] [retrieved from Thermo Soles website] (pdf) http://www.thermosoles.com/.

[Online] [retrieved on Jan. 22, 2014] [retreived from Warmers.com website] (pdf) http://www.warmers.com/grabber-got-warmers-medium-5-hour-10pr-bundle.

PCT, International Search Report & Written Opinion of the International Searching Authority for PCT/US2013/026932, dated Jun. 18, 2013.

PCT, International Search Report & Written Opinion of the International Searching Authority for Counterpart International Patent Application No. PCT/US2006/014681, dated Jul. 27, 2006.

PCT, International Search Report & Written Opinon of the International Searching Authority for Counterpart International Pataent Application No. PCT/US2013/057141, dated Nov. 12, 2013.

PCT, International Search Report & Written Opinon of the International Searching Authority for Counterpart International Patent Application No. PCT/US2014/0055133, dated Jan. 15, 2015.

PCT, International Search Report and Written Opinon of the International Searching Authority for Counterpart International Patent Application No. PCT/US2006/042885, dated Mar. 13, 2007.

Supplementary Extended European Search Report of the European Patent Office for European Search Report No. EP 13754536.4, dated Jun. 1, 2015.

(56) References Cited

OTHER PUBLICATIONS

PCT, International Search Report & Written Opinon of the International Searching Authority for Counterpart International Patent Application No. PCT/US2015/011960, dated Apr. 30, 2015.

* cited by examiner

CONTOURED SUPPORT SHOE INSOLE

CROSS REFERENCE TO RELATED APPLICATIONS

This application claims the benefit of U.S. Provisional Patent Application Ser. No. 62/167,771 filed May 28, 2015, U.S. Provisional Patent Application Ser. No. 62/182,060 filed Jun. 19, 2015, and U.S. Provisional Patent Application Ser. No. 62/234,212 filed Sep. 29, 2015.

STATEMENT REGARDING FEDERALLY SPONSORED RESEARCH OR DEVELOPMENT

Not applicable.

TECHNICAL FIELD

The present invention relates in general to an improved shoe insole and more particularly to an insole providing improved cushioning and support to the foot of a wearer.

BACKGROUND OF THE INVENTION

Insoles are inserted in the shoes of a user to provide one or more advantages to the comfort of the wearer or the support of the foot. Insoles are generally sold in pairs and one of each pair is adapted for use in a right shoe and the other adapted for use in a left shoe of a user. It is advantageous to provide appropriate structure to an insole so that it serves the purposes of the user.

The human foot is a very complex biological mechanism. The load on the foot at heel strike is typically about one and a half times a person's body weight when a person walks. When running or carrying extra weight, such as a backpack, loads on the foot can exceed three times the body weight. The many bones, muscles, ligaments, and tendons of the foot function to absorb and dissipate the forces of impact, carry the weight of the body and other loads, and provide forces for propulsion. Properly designed shoe insoles can assist the foot in performing these functions and protect the foot from injury.

Insoles may be custom made to address the specific needs of an individual. They may be made based on casts of the end user's foot or may be made of a thermoplastic material that is molded to the contours of the end user's foot. Like most custom made items, custom insoles tend to be expensive because of the low volume and extensive time needed to make and fit them properly. As such, it is not practical to make such custom made insoles for the general public.

To be practical for distribution to the general public, an insole must be able to provide benefit to the user without requiring individualized adjustment and fitting. A first type of insole commonly available over-the-counter emphasizes cushioning the foot so as to maximize shock absorption. For typical individuals cushioning insoles perform adequately while engaged in light to moderate activities, such as walking or running. That is, a cushioning insole provides sufficient cushioning and support for such activities. However, for more strenuous or technically challenging activities, such as carrying a heavy backpack or traversing difficult terrain, a typical cushioning insole will not be adequate. Under such conditions, a cushioning insole by itself would not provide enough support and control, and tends to bottom out during use by fully compressing the cushioning insole.

Another type of over-the-counter insole emphasizes control. Typically, such insoles are made to be relatively stiff and rigid so as to control the bending and twisting of the foot by limiting foot motion. The rigid structure is good at controlling motion, but is not very forgiving. As a result, when motion of the foot reaches a limit imposed by the rigid structure, the load on the foot tends to change abruptly and increases the load on the structures of the foot. Because biological tissues such as tendons and ligaments are sensitive to the rate at which they are loaded, the abrupt change in load causes injury or damage to the foot, ankle or leg.

In view of the foregoing, it would be desirable to provide an over-the-counter insole that provides both cushioning and control. It would also be desirable to provide an insole that provides both cushioning and control and is practical for use by the general public during cross-training or triathlon-related activities.

The Applicant has received patents for insoles having a support cushion and multiple pods located thereon. These patents include U.S. Pat. Nos. 7,484,319; 7,665,169; 7,908,768; and, 8,250,784. These prior art patents, however, do not address the problems of enhanced cushioning and stability, possible movement of the insole during shoe operation, or establishing enhanced cushioning characteristics to address running and walking usages.

There is a need for insoles to be easier to construct and made of materials that: (1) provide increased ankle and foot stability, (2) cushion the heel and forefoot during push-offs and landings, (3) custom-contour to the inside shape of all types of shoes, (4) are extremely light-weight, (5) provide enhanced cushioning capabilities and (6) have essentially zero movement or sliding while placed inside a shoe.

SUMMARY OF THE INVENTION

It is an object of the present invention to provide an insole that provides improved cushioning, support, and control and is practical for use by the general public. The above, and other objects and advantages of the present invention are provided by an insole that provides improved motion control, support and cushioning. The insole includes a system of interacting components that cooperate to achieve a desired combination of foot cushioning, support and motion control.

In accordance with principles of the present invention, the shoe insole 100 has a bottom surface formed of three pieces including: (1) a base layer extending from heel-to-toe, (2) a forefoot pad positioned in a forefoot/toe indentation on a forefoot base area of the insole, and, (3) a midfoot to heel support cushion made of a soft polyurethane positioned in a midfoot to heel indentation. The forefoot pad and the midfoot/heel support cushion are secured adjacent to one another on the bottom surface of the base layer. In one preferred embodiment the base bottom surface has indentations dimensioned to receive cushioning pads. In an alternative embodiment the base bottom surface has cushions and pads molded into the base bottom surface. A thin layer of nylon fabric may be positioned in the forefoot pad indentation between the forefoot pad and the material of the base bottom surface to increase the adhesion of the forefoot pad to the base material when the forefoot pad and base bottom surface are made of differing materials.

There is a raised separation wall located on the base layer between the forefoot/toe layer and the midfoot/heel support cushion, which is located laterally across the width of the insole between the metatarsal and forefoot areas on the insole. The insole has a top sheet layer that extends from heel to toe over the top surface of the base layer. There is a heel dome on the top surface of the insole and a metatarsal dome raised on the top surface of the insole, each of which respectively improves the cushioning characteristics of the insole at or near high impact points on the insole. The forefoot pad has a diamond cube shaped groove pattern on its bottom surface to improve forefoot cushioning characteristics, and improve traction and adhesion of the insole inside and along the interior bottom surface of the user's shoe. In an alternate embodiment, the forefoot pad has a honeycomb-shaped pattern. In yet another embodiment, the forefoot pad has a texturized un-patterned surface.

The midfoot/heel cushion has a raised arch in the medial arch area and longitudinal curvilinear indentations positioned along a major angle compared to the longitudinal axis of the insole, with the longitudinal axis extending from heel-to-toe on the insole. The midfoot/heel cushion also possesses a flattened midfoot area on the midfoot area and a metatarsal midfoot tear-drop raised area positioned in a metatarsal tear-drop aperture of the midfoot to heel support cushion. The flattened area on the midfoot area of the midfoot/heel cushion is bordered on the medial side by a medial side longitudinal ridge, on the lateral side by a lateral side longitudinal ridge, and around the exterior of the heel pod opening by a heel ridge. The midfoot/heel cushion also has a surrounding heel cup that supports the exterior back of the user's heel with the heel cup and extends to the raised arch area.

The heel pod opening extends through the entirety of the thickness of the midfoot/heel support cushion to position the heel pad on the bottom surface of the base layer. The heel pod opening is surrounded by opening border grooves, which surrounds the circumference of the heel pod opening. The heel pad is located on the bottom surface of the insole and is made of a EVA or other suitable material and extends through the full depth of the heel pod opening and is attached to the bottom surface of the base layer. The heel pad has a diamond cube shaped groove pattern and there is a supersoft heel dome on the top (foot contact) surface of the insole located above the heel pod in the bottom (shoe contact) surface.

A shoe insole with the following features: (1) a base made of molded of lightweight materials such as low density polyurethane memory foam, ethylene glycol polyurethane, ethylene vinyl acetate (EVA), pre-blown EVA, polyurethane (PU), or thermoplastic rubber (TPR) or other suitable material with hardness of the molded base material can range from less than 10 Asker±3 to greater than 30 Asker±3 extending the length and width of the insole curving up in the medial arch area to form an arch support area and curving around the heel area to form a heel cup on the foot contact surface, with a separating wall between the base material and the forefoot pad indentation area on the bottom surface; a heel pad indentation under the calcaneal (heel) area on the bottom surface; a raised arch in the medial arch area with integrally formed longitudinal curvilinear indentations situated lengthwise, integrally formed raised gripping ridges in the medial arch area on the bottom surface; and a teardrop shaped indentation in the metatarsal area of the midfoot which curves upwardly (concave) from the bottom of the base bottom (shoe contact) surface and forms a collapsible metatarsal support which is convex on the top (foot contact) side of the base layer; (2) a forefoot pad of molded of pre-blown ethylene vinyl acetate (EVA), polyurethane (PU), or thermoplastic rubber (TPR) or other suitable material, which extends from the toe end of the insole to the lateral midfoot/arch area from the medial side to the lateral side of the forefoot area with a diamond-cube pattern molded and having pattern spacing of about 1 mm, groove depth of approximately 1 mm, and a thickness of the forefoot pad of about 1.5 mm±0.5 mm, the forefoot pad molded into the PU insole base distal to the separating wall on the base bottom surface with a knitted fabric layer secured between the forefoot pad and the PU base material; (2) a heel pad on the bottom surface of the insole made of pre-blown ethylene vinyl acetate (EVA), molded of EVA, polyurethane (PU), or thermoplastic rubber (TPR) or other suitable material with a hardness of approximately 35 Asker C±3, a thickness of approximately 3.0 mm±0.5 mm, or alternatively, integrally formed in the material of the base bottom surface of the insole, and having a modified oval shape that is wider on the proximal end of the heel pad and narrows on the distal end of the heel pad with a diamond-cube pattern molded in the EVA having pattern spacing of about 1 mm, groove depth of approximately 1 mm, and a thickness of the heel pad of about 1.5 mm±0.5 mm and which is secured in the heel pad indentation of the base bottom surface; (3) a supersoft heel dome on the top (foot contact) surface of the insole which would be directly above the heel pad in the bottom (shoe contact) surface providing heel cushioning directly under a user's heel bone and also providing shock absorption on the insole bottom; (4) a metatarsal dome shaped like a teardrop on the top (foot contact) midfoot surface of the insole which would normally be located below the foot metatarsal bones; and, (5) a top sheet of polyester covering the entire foot contact surface of the insole which is treated with an antimicrobial agent.

In an alternate embodiment, the heel pad has a honeycomb-shaped pattern. In yet another embodiment, the heel pad has a texturized un-patterned surface, and a thin layer of nylon fabric may be positioned in the heel pad indentation between the heel pad and the material of the base bottom surface to increase the adhesion of the heel pad to the base material when the heel pad and base bottom surface are made of differing materials.

In a preferred embodiment, the heel pad is surrounded by a flat midfoot/heel surface and cupped along the back by a heel cup, nylon fabric between forefoot/heel pads and base (for adhesion of pads to PU), a raised oval heel pad on top dome on the foot-contact side made of super-soft low density PU, a medial arch that has raised and indented curvilinear lines extending longitudinally along arch with vent holes, a groove depth on bottom 0.50 mm-1.5 mm, a top cloth made of 65% Nylon/35% polyester, a teardrop metatarsal dome on the top side is integrally formed as an upwardly-curved indentation from bottom surface, a diamond-shaped groove pattern on the forefoot pad and the heel pad, and a separation wall added between base and forefoot pad of approximately 1 mm.

Overall, the above features appear to be novel characteristics for this insole, and seem to be patentably distinct from the other insoles. The method of construction of the present insole is also a unique and novel feature of the present invention. In accordance with principles of the present invention, a cushioning core or base is combined with a relatively stiff support cushion and a number of other pads to form an insole that provides greater cushioning, stability, and control than was conventionally known in the state of the art. The pads can have a different firmness than the base or the support cushion. The pads and support cushion assist with prevention of supination, and the supplemental heel pad assists with the prevention of pronation. The current invention is an insole that provides a balanced approach to improving longitudinal arch support, prevention of pronation and prevention of supination by incorporation of the combination of the above elements.

The characteristics of the components, their size and shape, and their position are selected to provide a desired blend of improved cushioning and control, and more specifically to achieve a desired biomechanical function. The size and compression characteristics of the pads can be adjusted to address issues of over/under pronation, over/under supination, and other problems related to foot motion, including altering the size, shape, and material properties of the pads. The firmness of the pads and support cushion can be adjusted to address issues of over/under pronation, over/under supination, and other problems related to foot motion by altering the size, shape, and material properties of the pads. The present invention accomplishes the goals to: (1) improve ankle and foot stability, (2) cushion the heel and forefoot during push-offs and landings, (3) help prevent over pronation and over supination conditions, and (4) provide enhanced cushioning features to the heel, midfoot, arch and forefoot areas. In a preferred embodiment of the present invention, the components of an insole are permanently affixed to each other to create an insole designed for an intended type or category of activity. Many different insole designs can be made to address a broad range of different activities.

BRIEF DESCRIPTION OF THE DRAWINGS

The above, and other objects and advantages of the present invention will be understood upon consideration of the following detailed description taken in conjunction with the accompanying drawings, in which like reference characters refer to like parts throughout, and in which.

DETAILED DESCRIPTION

In accordance with principles of the present invention, the present invention is a shoe insole has a base bottom (shoe contact) surface with cushioning and supporting elements in the arch, metatarsal, forefoot and heel areas, and a top (foot contact) surface with cushioning and supporting elements in the heel and metatarsal areas. The shoe insole fits securely in the bottom of a user's shoe to provide support and cushioning to the user's foot.

Figure 1A:
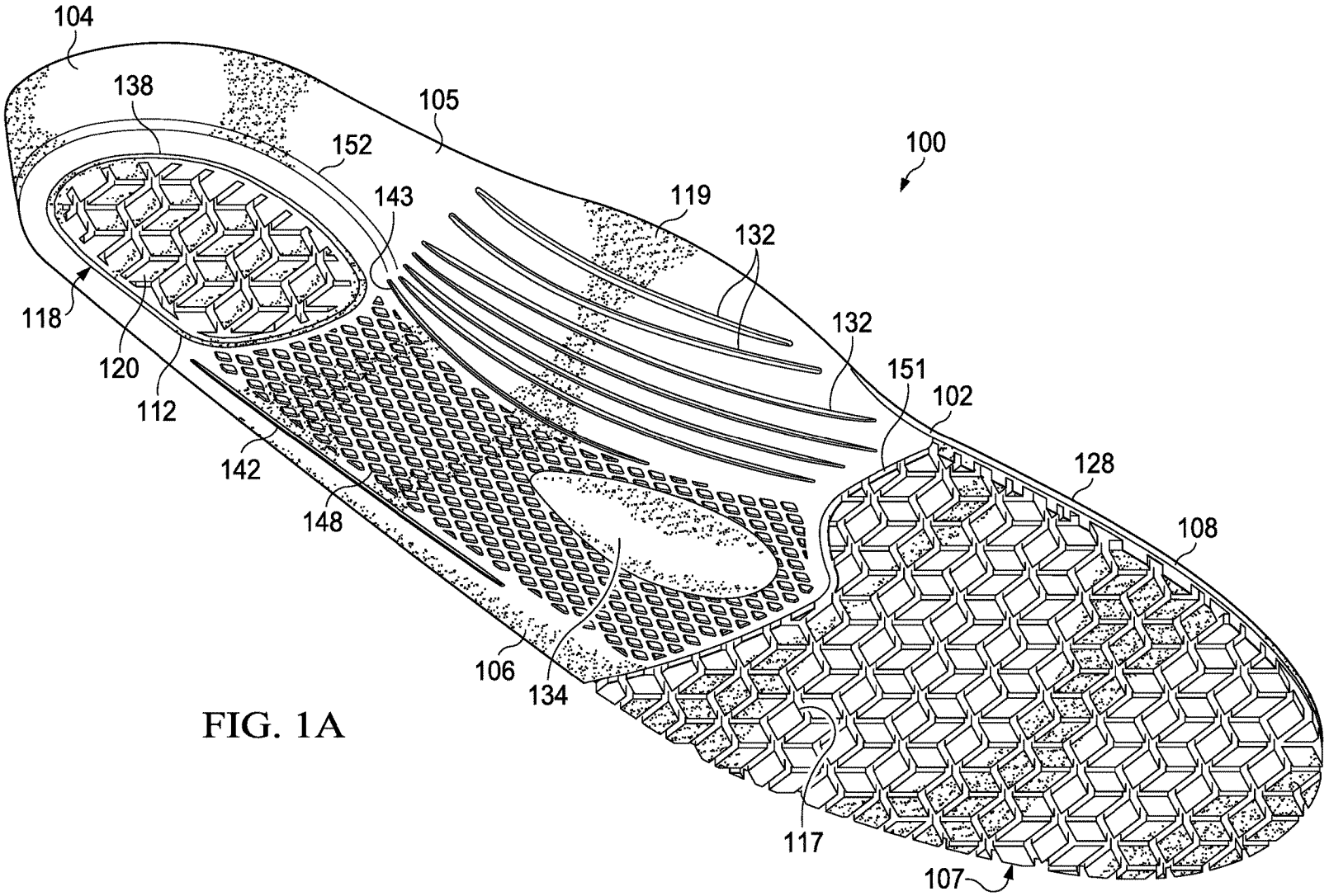
FIG. 1A is a bottom perspective view of an illustrative embodiment of an insole in accordance with the principles of the present invention.
Figure 1B:
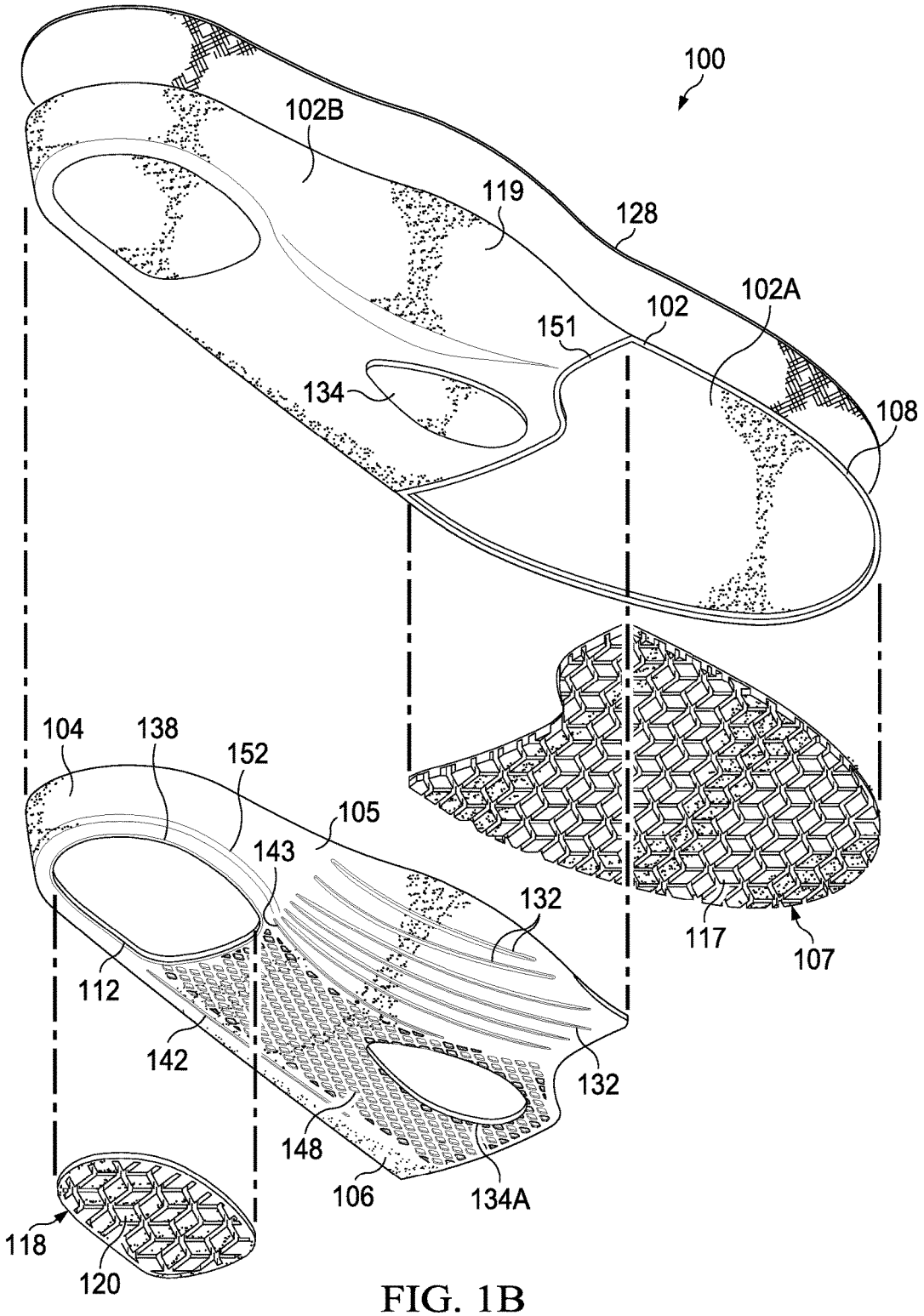
FIG. 1B is a exploded perspective view of an illustrative embodiment of an insole in accordance with the principles of the present invention.
Figure 2:
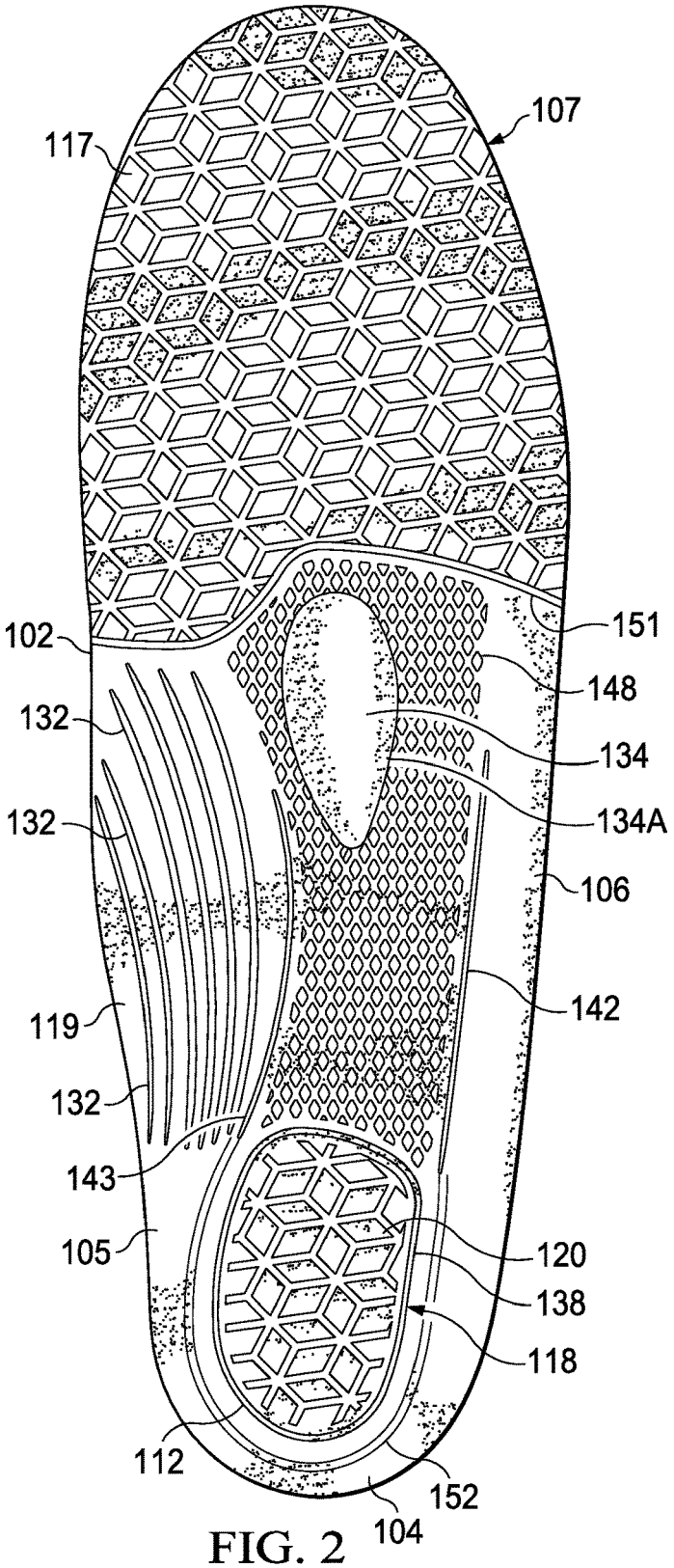
FIG. 2 is a bottom planar view showing the base bottom surface of the insole.

Referring to FIG. 1A, 1B and 2, these views are perspective and top views of the bottom surface (shoe side) of an insole 100 according to the invention. The insole 100 extends from a heel end (proximal) to a toe end (distal) and has a medial border or side on the arch side of the foot, connecting said toe end to said heel end along the arch side of the insole and a lateral border or side on the other side (opposite side from medial side) thereof, connecting said toe end to said heel end on the other side of the insole.

The insole 100 surface is generally foot-shaped extending longitudinally from the from the toe end to the heel end and from the medial side to the lateral side of the insole. In one preferred embodiment, the base layer 102 surface has indentations dimensioned to receive cushioning pads. In an alternative embodiment, the base bottom surface has cushioning pads molded into the base bottom surface.

The invention possesses a base layer 102, support cushions 105 and pads 107 that can be made of molded or lightweight materials such as low density polyurethane memory foam, ethylene glycol polyurethane, ethylene vinyl acetate (EVA), pre-blown EVA, polyurethane (PU), or thermoplastic rubber (TPR) or other suitable material. Hardness of the molded base material can range from less than 10 Asker±3 to greater than 30 Asker±3. The insole 100 encompasses support and cushioning features for the following functional areas: forefoot cushioning area; medial arch support area, metatarsal support area, and a heel cushioning area. In a preferred embodiment, the base layer 102 has indentations in the forefoot area 108 dimensioned to receive a forefoot pad 107, and/or in the heel area 104 dimensioned to receive a heel pad 118. In an alternate embodiment, the forefoot pad 107 and the heel pad 118 are molded into the base material.

The base layer 102 extends the length and width of the insole curving up in the medial arch area to form an arch support 119 and curving around the heel area to form a heel cup 104 on the foot contact surface, with a separating wall 151 between the base material and the forefoot pad indentation area on the bottom surface; a heel pad indentation 102B under the calcaneal (heel) area on the bottom surface; a raised arch 119 in the medial arch area with integrally formed longitudinal curvilinear indentations 132 situated lengthwise, the curvilinear indentations 132 integrally formed raised gripping ridges in the medial arch area on the bottom surface; and a teardrop shaped metatarsal indentation 134 on the bottom surface of the insole 100 that curves upwardly (concave) from the bottom of the base bottom (shoe contact) surface and forms a collapsible metatarsal support which is convex on the top (foot contact) side of the base layer 102. The insole also has: (1) a forefoot pad 107 that extends from the toe end of the insole 100 to the midfoot area and from the medial side to the lateral side of the forefoot area with a diamond-cube pattern 117 molded having pattern spacing of about 1 mm and a depth of about 1.5 mm, the forefoot pad molded into the PU insole base distal to the separation wall 151 on the base bottom surface with a knitted fabric layer secured between the forefoot pad 107 and the base layer 102 material; (2) a heel pad 118 on the bottom surface of the insole made of pre-blown EVA, polyurethane (PU), or thermoplastic rubber (TPR) or other suitable material with a hardness of approximately 10-35 Asker C±3 having a modified oval shape that is wider on the proximal end of the heel pad and narrows on the distal end of the heel pad with a diamond-cube pattern molded in the EVA having pattern spacing of about 1 mm and a depth of about 1.5 mm and which is secured in the heel pad indentation of the base bottom surface; (3) a soft heel dome 118A (shown in FIGS. 3 and 6) on the top (foot contact) surface of the insole 100 which would be directly above the heel pad 118 in the bottom (shoe contact) surface providing heel cushioning directly under a user's heel bone and also providing shock absorption on the insole bottom; (4) a soft metatarsal dome 134 shaped like a tear drop on the top (foot contact) surface (shown in FIGS. 3, 5 and 6) providing cushioning directly over the metatarsal area of the foot; and, (5) a top sheet 128 of polyester covering the entire foot contact surface of the insole 100 which is treated with an antimicrobial agent.

The combination of the base layer 102, support cushion 105, and a heel pad 118 specified herein provides a "degree" of medial longitudinal arch support, which provides a couple of degrees of improved pronation "control." A "degree" of medial longitudinal arch support is approximately 1-2 degrees based on research evidence. By pronation "control," we mean the increase in supination moments acting around the joints of the rearfoot and the decrease in the magnitude of pronation moments. The current invention is an insole 100 that provides a balanced approach to improving longitudinal arch support, prevention of pronation and prevention of supination.

The insole 100 also has a forefoot area 108 that correlates with the metatarsal area and near the phalanges of the foot located over the forefoot pad 107 of the insole 100, a raised arch support 119 along the medial arch side, a heel area just forward of the heel cup 104, and a midfoot area 106 between the heel area 104 and forefoot area 108. A user's right shoe and left shoe are mirror images of one another as are the insoles adapted to be inserted in a right shoe and a left shoe respectively. Only the left insole is illustrated in the Figures. It will be understood by those of skill in the art that the right insole has a mirror image construction of the left insole.

In one preferred embodiment, the base layer 102 has indentations 102A, 102B dimensioned to receive cushioning pads. In an alternative embodiment, the base bottom surface 102 has cushioning pads molded into the base bottom surface. The base layer 102 may be molded of lightweight materials such as low density polyurethane memory foam, ethylene glycol polyurethane, ethylene vinyl acetate (EVA), pre-blown EVA, polyurethane (PU), or thermoplastic rubber (TPR) or other suitable material. Hardness of the molded base layer 102 material can range from less than 10 Asker±3 to greater than 30 Asker±3.

The present invention is an insole that fits within the interior of a user's shoe, and rests on the interior bottom surface of that shoe with the user's foot being positioned over and on top of the insole. The insole 100 shown in FIG. 1A, 1B and 2 has a bottom (shoe side) and a top (foot side) and the insole 100 comprises a base layer 102 having a contoured shape which receives and supports the foot of the user. The insole 100 is intended to be used inside a shoe and the bottom side thereof will contact the interior of a shoe after insertion therein. In many cases, the insole will be used to replace an insole that previously was used in the shoe.

The base layer 102 has a heel end, a toe end, a lateral side and a medial side, said sides extending approximately from said heel end to said toe end. The lateral side lies adjacent the outer side of a user's foot in use and the medial side lies adjacent the inner side, or arch, of a user's foot in use, including the arch of the foot. The contoured shape includes an integrally formed raised arch support 119 that extends generally upwardly on the medial side of the insole. This upward extension arch support 119 allows the raised arch support to lie adjacent to a user's foot arch during use in the shoe.

As an example, approximate dimensions are given for a men's size 9 insole. Length and width of the insole are 28.1 cm (11.063 inches) and 9.7 cm (3.813 inches). The length and width will vary according to the shoe size for which the insole is intended. The total thickness of the insole can range from 6.8 millimeters near the toe area to 12 millimeters in the arch area. Arch height is about 15 millimeters. The forefoot and heel cushions have a thickness of approximately 4.0 millimeters. The preferred depth of the heel cup which is measured from the top side of the insole near the center of the heel area vertically to the top of the upraised heel area or heel raised edge is approximately 15-16 millimeters.

The base layer 102 has a base top surface and a base bottom surface. The base layer 102 defines a heel cup 104 adjacent said heel end, a contoured arch support 119 adjacent said medial side, a midfoot area 106 between said arch support 119 and the lateral midfoot area, a forefoot area 108 located between the metatarsal area to the toe end of the insole 100. There is a heel dome 118A on top surface of insole (shown in FIGS. 3 and 6) and a metatarsal dome 134 raised on the top surface of insole 100 (shown in FIGS. 3, 5 and 6), each of which respectively improves the cushioning characteristics of the insole at or near high impact points on the insole.

Base layer 102 is preferably made of foam or other material having suitable cushioning properties, including a fabric layer. Preferably, base layer 102 comprises an Ethylene vinyl acetate ("EVA") foam, which is a copolymer of ethylene and vinyl acetate, a Thermoplastic Rubber ("TPR")/EVA mix, or a blown EVA material. A preferred blown EVA, EVA or TPR/EVA mix has a durometer (hardness) of about Asker C 45-50. It is desirable to minimize the total weight of the insoles by selection of materials that promote the structural features of the insole. It is desirable that the total weight of the preferred embodiment of the insole (men's size 10/11) be about 4.0 ounces. It is desirable that the total weight of an alternate embodiment of the insole be about 5.0 to 6.0 ounces for a men's size 10/11 and about 6.5 to 7.5 ounces for a men's size 12/13. Other sizes will be proportional. The base layer may be formed from a gel material or made of polyurethane polyester glycol with a hardness of 30 Asker±3, or alternatively, can be made of a durable nylon fabric.

The base layer 102 is covered by a top sheet 128 that extends across the top surface of the base layer 102 from heel to toe end, and creates a top surface of the insole 100. The top sheet 128 is made of polyester or jadeite covering the entire foot contact surface of the insole, and is treated with an antimicrobial agent. Top sheet 128 is typically made of a non-woven fabric layer with a low coefficient of friction so as to minimize the possibility of blisters, or preferably, top sheet 128 is made of a cooling fabric which contains a special low temperature jade obtained from a natural source.

The top sheet 128 bottom surface is secured by an adhesive to base layer 102 top surface and a top sheet upper surface which contacts the foot of a user during use. The top sheet 128 is oriented to engage the user's foot on the top surface of the insole, and it serves an upper cooling and ventilation function, and the top sheet 128 can be made of suitable materials, such as a jadeite top cloth material. Preferably, the top sheet 128 is made of a low-friction fabric which prevents blisters on the user's foot. The top sheet 128 may also contain an antimicrobial treatment in order to keep bacteria from multiplying and therefore reduce odor. A suitable treatment is Silpure® antimicrobial treatment (Thomson Research Associates, Inc., Ontario, Calif.).

In accordance with principles of the present invention and as shown in FIG. 1A, 1B and 2, the shoe insole 100 has a bottom surface formed of three pieces including: (1) a base layer 102 extending from heel-to-toe, (2) a forefoot pad layer 107 positioned in a forefoot pad indentation area 102A on a forefoot area 108 of the insole 100, and, (3) a midfoot-to-heel support cushion 105 made of a soft polyurethane positioned in a midfoot-to-heel indentation 102B. The three-piece bottom surface construction makes fabrication easier than known methods, and allows for different combinations of materials and cushioning characteristics and support by adjusting the materials used in the forefoot pad 107, base layer 102, the midfoot-to-heel support cushion 105, and the heel pad 118.

In a preferred embodiment, the insole 100 has a base layer 102, which can be a polyurethane or fabric sheet, coupled to a midfoot-to-heel support cushion 105 made of low density polyurethane memory foam, ethylene glycol polyurethane, ethylene vinyl acetate (EVA), pre-blown EVA, polyurethane (PU), thermoplastic rubber (TPR) or other suitable material having a midfoot surface 148 with a small diamond pattern and having a hardness of the molded base material can range from less than 10 Asker±3 to greater than 30 Asker±3; a forefoot pad 107 molded of lightweight materials such as low density polyurethane memory foam, ethylene glycol polyurethane, ethylene vinyl acetate (EVA), pre-blown EVA, polyurethane (PU), or thermoplastic rubber (TPR) or other suitable material (hardness 10-35 Asker±3) (diamond cube pattern 117 spacing 1.0 mm-1.50 mm), a heel pad 118 made of pre-blown EVA, PU, or other suitable material (hardness 10-35 Asker±3) (diamond cube pattern spacing 1.0 mm-1.50 mm) surrounded by a flat surface 152 on the base layer 102 and cupped along the back by a heel cup 104, nylon fabric between forefoot/heel pads and base (for adhesion of pads to PU), a raised oval heel dome 118A on top surface of the insole on the foot-contact side (shown in FIGS. 3 and 6) made of super-soft low density PU, a raised medial arch 119 that has raised and indented curvilinear lines extending generally longitudinally along arch with vent holes, a groove depth on bottom 0.50 mm-1.5 mm, a top cloth made of 65% Nylon/35% polyester, a teardrop metatarsal dome 134 on top side of the insole 100 (shown in FIGS. 3, 5 and 6) and integrally formed as upwardly-curved indentation raised above the bottom layer 102, a diamond cube pattern 117, 120 on the bottom surface of the forefoot pad 107 and the heel pad 118, respectively, and a separation wall 151 added between midfoot-to-heel cushion 105 and forefoot pad 107 of approximately 1 mm.

The metatarsal support 134 in formed in a metatarsal support aperture 134A, which is integrally formed in the bottom surface of the support cushion 105 on the bottom surface of the insole and it has a concave surface oriented toward the bottom (shoe contact) surface and a convex surface oriented toward the top (foot contact) surface. The metatarsal support 134 is positioned in the midfoot area 106 of the insole 100 to provide cushioning and support in the area approximately under the second and third metatarsal bones. The metatarsal support 134 is compressible with the convex top surface being compressed by foot pressure downward toward the concave portion of the base bottom surface allowing the support provided to vary with the pressure of the user's foot.

In a preferred embodiment, the metatarsal support 134 is teardrop shaped with the wider part of the shape oriented distally to the insole under the second and third metatarsal bones and the narrow part of the shape oriented proximally towards the tarsal bones. In an alternate embodiment, the metatarsal support may have another shape, such as diamond, rectangle or other shape suitable for providing metatarsal support in the midfoot area of the insole.

The metatarsal support 134 is integrally formed in the material forming the base bottom surface of the insole 100 which is preferably molded of low density polyurethane memory foam, but may also be ethylene glycol polyurethane, ethylene vinyl acetate (EVA), pre-blown EVA, polyurethane (PU), thermoplastic rubber (TPR) or other suitable material. Hardness of the molded base material can range from less than 10 Asker±3 to greater than 30 Asker±3.

Forefoot pad 107 is shaped essentially the same as forefoot pad indentation area 102A and is secured therein. Forefoot pad 107 has a medial edge, a lateral edge, a proximal (back) edge and a distal (front) edge. The medial edge of forefoot pad 107 extends along a line spaced laterally from said medial border of said insole. The proximal edge extends from said medial edge laterally and proximally to said rear apex, laterally and distally towards the $3^{rd}$ metatarsal head, then laterally and proximally to the lateral edge approximately along the $3^{rd}$ through $5^{th}$ metatarsal heads.

The forefoot pad 107 generally extends from the proximal region of the metatarsal head area to the distal toe end of the insole and extends from the medial side to the lateral side of the insole. In one embodiment, the forefoot pad 107 is secured within a forefoot pad indentation 102A. The forefoot pad 107 has a thickness of approximately 1.5 mm±0.5 mm. In another embodiment, the forefoot pad 107 is integrally formed in the material of the base layer 102 of the insole 100. The forefoot pad 107 is preferably molded of pre-blown ethylene vinyl acetate (EVA). The forefoot pad 107 may also be molded of EVA, polyurethane (PU), or thermoplastic rubber (TPR) or other suitable material.

Preferably, the forefoot pad 107 has a diamond-cube pattern 117 on the forefoot pad 107 surface to provide traction, compressive cushioning and lateral movement support to the forefoot area. The diamond cube pattern 117 has a depth of approximately 1.0 mm 0.5 mm and has a surface pattern spacing of about 1.0 mm to about 1.5 mm. In an alternate embodiment, the forefoot pad 107 has a honeycomb-shaped pattern 117. In yet another embodiment, the forefoot pad 107 has a texturized un-patterned surface 117. A thin layer of nylon fabric may be positioned in the forefoot pad indentation 102A between the forefoot pad 107 and the material of the base layer 102 to increase the adhesion of the forefoot pad 107 to the base layer 102 when the forefoot pad 107 and base layer 102 are made of differing materials.

The forefoot pad 107 extends from the toe end of the insole to the lateral midfoot/arch area from the medial side to the lateral side of the forefoot area with a diamond-cube pattern 117 having pattern spacing of about 1 mm and a depth of about 1.5 mm. The forefoot pad 107 made of molded of lightweight materials such as low density polyurethane memory foam, ethylene glycol polyurethane, ethylene vinyl acetate (EVA), pre-blown EVA, polyurethane (PU), or thermoplastic rubber (TPR) or other suitable material (hardness 10-35 Asker±3) (pattern spacing 1.0 mm-1.50 mm). The firmness of the forefoot pad 107 can be adjusted to address issues of over/under pronation, over/under supination, and other problems related to foot motion by altering the size, shape, and material properties of the pads. The configuration, material and position of the forefoot pad 107 provides cushioning and works in association with other items to stabilize the ankle. The forefoot pads and heel pads are made of rubber or synthetic rubber, which includes being made of a neoprene synthetic rubber layer which is a polymer.

The lateral edge of the forefoot pad 107 connects said proximal edge to said top edge of said forefoot pad 107. In use, forefoot pad indentation area 102A and forefoot pad 107 underlie a portion of the big toe of a user's foot, and the "ball" of the foot, excluding the first metatarsal head or medial ball of the user's foot. The forefoot pad 107 provides cushioning and energy return on landing from a vertical jump. It serves as a propulsion pad and support for the metatarsal heads of a user's foot, especially the 1st and 2nd metatarsal heads. The forefoot pad 107 has a diamond cube pattern 117 on its bottom surface to improve forefoot cushioning characteristics, which improves traction and adhesion of the insole inside and along the interior bottom surface of the user's shoe and improves durability and cushioning aspects of the forefoot pad over known materials.

The support cushion 105 is made of polyurethane polyester glycol (hardness 10-30 Asker±3—low density). The support cushion indentation area 102B is located in the midfoot and heel areas of the bottom surface of the insole. The midfoot-to-heel support cushion indentation area 102B extends from a medial edge approximate the medial border to a lateral edge approximate the lateral border of the base layer 102 and from a distal edge slightly proximal of the forefoot pad indentation area 102A to a proximal edge approximate the heel end 104 of the base. A medial portion of the distal edge is shaped to accommodate downward motion of the 1st metatarsal during toe off. Support cushion 105 is shaped essentially the same as midfoot-to-heel support cushion indentation area 102B and has a base facing surface and a shoe facing surface. The base facing surface is secured to said midfoot-to-heel support cushion indentation area 102B.

The midfoot/heel support cushion 105 has a raised arch 119 in the medial arch area and curvilinear indentations 132 positioned along at least two or more major angles from the longitudinal axis, with the longitudinal axis extending from heel-to-toe on the insole 100. Longitudinal curvilinear indentations 132 extend in a first angled direction compared to the longitudinal axis of the insole 100. The first angled directions is measured compared to the major axis lengths of the longitudinal curvilinear indentations 132. The first angled direction is approximately 5 degrees to 65 degrees compared to the longitudinal axis, which is the lengthwise axis extending from heel to toe on the insole 100. The longitudinal curvilinear indentations 132 in the raised arch area 119 provide additional rigidity to the raised arch support, which improves support raised arch 119 in the support cushion 105. These indentations 132 in this formation also promote polyurethane material flow in the area of the midfoot while assisting to minimize voids caused by air entrapment. The curvilinear indentations 132 on the bottom surface of the raised arch 119 also allow the raised arch 119 to collapse to fit the shoe thus providing a more accommodative design.

The midfoot/heel cushion 105 also possesses a flattened midfoot area 148 on the bottom surface of the insole 100 in midfoot area 106 and a metatarsal midfoot tear-drop raised area 134 positioned in a metatarsal tear-drop aperture 134A (e.g. metatarsal opening 134A) of the midfoot to heel support cushion 105. The flattened midfoot area 148 on the bottom surface of the insole 100 in the midfoot area 106 of the midfoot/heel cushion 105 is bordered on the medial side by a medial side longitudinal ridge 142 extending from midfoot to heel, on the lateral side by a lateral side longitudinal ridge 143 extending midfoot to heel, and around the exterior of the heel pod opening 112 by a heel ridge 152. This ridge 143, 142 and 152 improves the support and durability of the support cushion 105 and helps prevent pronation and supination rotations on the user's foot during use, which enhances and improves the performance of the insole. The midfoot/heel support cushion 105 also has a surrounding heel cup 104 that supports the exterior back of the user's heel with the heel cup 104 and extends to the raised arch area 119, which also improves the support provided to the user's foot during use.

Support cushion 105 has side and end walls that wrap up the sides and rear of base layer 102 to provide support for the foot by cupping the outside areas of the heel, providing stability stiffness from the midfoot to the heel area, and providing an upward support in the medial arch area of the user's foot. Preferably, midfoot-to-heel support cushion 105 ranges from approximately 0.5 mm to 3 mm thick and the walls taper from approximately 3 mm to about 0.5 mm. The first or second set of longitudinal indentations have a groove depth of approximately 0.50 mm-1.5 mm.

There is a raised separation wall 151 located on the base layer 102 between the forefoot pad 107 and the midfoot/heel support cushion 105, which is located laterally across the width of the insole 100 between the metatarsal and forefoot areas on the insole 100. The separation wall provides isolation of the forefoot pad 107 from the midfoot-to-heel support cushion 105, which improves the cushioning characteristics of those materials as well as improving the support of the insole 100. The separation wall 151 located on the bottom surface of the base layer 102 and is approximately 1 mm in height. At the beginning of the propulsion or toe off phase of a step, the heel begins to lift from the ground and weight shifts to the ball of the foot. Forefoot pad 107 is located under this part of the foot. Preferably, forefoot pad 107 is formed of a relatively resilient material so that energy put into compressing forefoot pad 107 is returned to help propel the foot at toe off.

During toe off, the first metatarsal naturally flexes downward. Preventing this natural downward flex of the first metatarsal causes the arch of the foot to flatten and the foot to over pronate, increasing stress on the ankles and knees. To accommodate the downward flex, the forefoot pad 107 extends rearward into a corresponding concave edge portion of the distal edge of separation wall 151. The shape of the forefoot pad 107 permit the first metatarsal to flex more naturally and thereby encourage loading of the great toe during toe off.

The heel pod opening 112 extends through the entirety of the thickness of the midfoot/heel support cushion 105 to position the heel pad 118 on the bottom surface of the base layer 102. The heel pad aperture is surrounded by a flat midfoot/heel surface with surrounding grooves. The heel pod opening 112 is surrounded circumferentially by heel pod opening border grooves 138, which surrounds the circumference of the heel pod opening 112. These grooves isolate the heel pad 118 from the midfoot-to-heel support cushion 105, which improves the performance of the heel pad 118 by isolating the heel pad 118 and preventing migration of the cushioning effect laterally (cushioning effect absorbs directional impact force better with supporting grooves). The heel pad 118 is located in the heel pod opening 112 and affixed to the bottom surface of the insole 100, and the heel pad 118 that extends from the proximate end of the heel (calcaneal bone) area to an area adjacent the proximal portion of the medial arch support area. In a preferred embodiment, the heel cushioning area has a heel pad 118 secured within a heel pad opening 112 formed in support cushion 105 with the heel pad 118 being secured to base layer 102 of the insole 100.

The heel pad 118 has a thickness of approximately 3.0 mm±0.5 mm. In an alternate embodiment, the heel pad 118 is integrally formed in the material of the base bottom surface of the insole. The heel pad 118 provides compressive cushioning and support under the heel (calcaneal) bone. Preferably, the heel pad 118 has a diamond-cube pattern 120 on the heel pad 118 surface to provide compressive cushioning and support to the heel area. The diamond cube pattern 120 has a depth of approximately 1.5 mm±0.5 mm and has a surface pattern spacing of about 1.0 mm to about 1.5 mm. In an alternate embodiment, the heel pad 118 has a honeycomb-shaped pattern, and, in yet another embodiment, the heel pad 118 has a texturized un-patterned surface.

The heel pad 118 is preferably molded of pre-blown ethylene vinyl acetate (EVA). The heel pad 118 may also be molded of EVA, polyurethane (PU), or thermoplastic rubber (TPR) or other suitable material. A thin layer of nylon fabric may be positioned in the heel pad 118 between the heel pad 118 and the material of the base layer 102 to increase the adhesion of the heel pad 118 to the base layer 102 when the heel pad 118 and base layer 102 are made of differing materials.

The heel pad 118 has a diamond cube pattern 120 to improve heel cushioning characteristics and improve traction and adhesion of the insole inside and along the interior bottom surface of the user's shoe. The heel pad 118 can be made from a TPR gel or made of pre-blown EVA (ethylene-vinyl acetate) material, and the heel pad has a hardness rating of 10-35 Asker±3. The heel pad has a diamond cube pattern 120 with a width spacing of approximately 1.0 mm-1.50 mm. There is a soft heel dome 118A on the top (foot contact) surface of the insole (shown in FIGS. 3 and 5) located above the heel pad 118 in the bottom (shoe contact) surface providing heel cushioning directly under a user's heel bone and also providing shock absorption on the insole bottom.

Insole 100 production can be accomplished by an open-pour molding process. The process consists of pouring mixed polyurethane or TPR into an open mold. Once poured in the mold, the polyurethane mixture will expand to fill the cavity. Once cured, the base insole is removed from the mold. The forefoot cushion and heel cushion if employed can be secured to the indentations by adhesive or can be secured in place during the polyethylene pouring operation. Bonding occurs to a fabric that is bonded to the forefoot cushion or the heel cushion.

Alternatively, the forefoot pad 107 can be molded onto the bottom surface of the insole base layer 102 from the forefoot pad indentation 102A up to the separation wall 151 on the base bottom surface of the base layer 102. A fabric layer may be inserted between the forefoot pad 107 and the base layer 102 in the forefoot pad indention 102A. And, the midfoot/heel cushion 105 can be molded onto the bottom surface of the insole base layer 102 from the indentation 102B up to the separation wall 151 on the base bottom surface of the base layer 102. A fabric layer may be inserted between the midfoot-to-heel support cushion 105 and the base layer 102 in the indentation 102B. Also, the heel pad 118 can be molded onto the bottom surface of insole base layer 102 in the heel pod opening 112. A fabric layer may be inserted between the heel pad 118 and the base layer 102 in the support cushion indentation area 102B. The forefoot pad 107, the heel pad 118, and the midfoot/heel support cushion 105 can also be secured adjacent to one another on the bottom surface of the base layer 102 with an adhesive that is suitable for creating a semi-permanent (or permanent) bond or adhesive, which may be liquid upon application but firms into a solid. The curvilinear indentations 132 are preferably molded into the support cushion 105 during manufacture.

Figure 3:
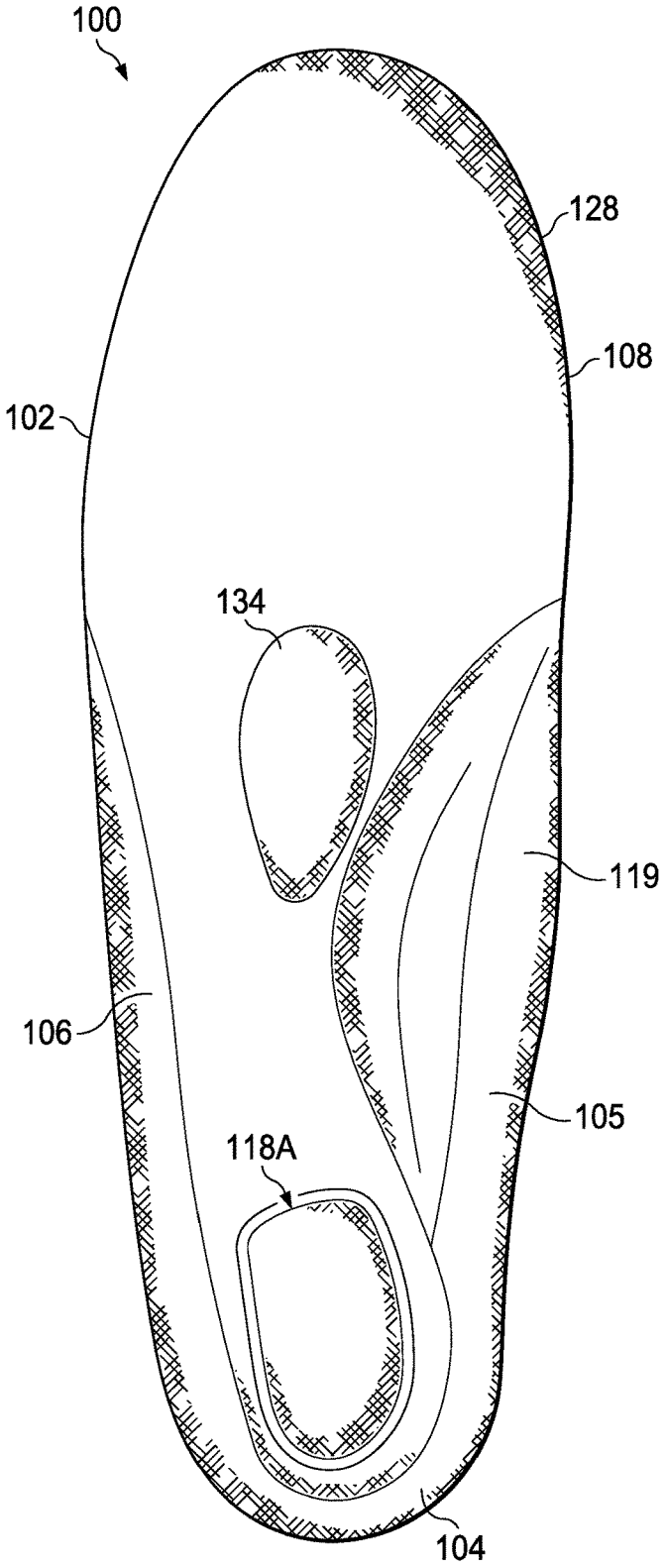
FIG. 3 is a top (dorsal) view of the insole.

FIG. 3 illustrates the top (foot side) of an insole according to the invention with a top sheet 128 covering the top side of the insole 100, which is placed over the base layer 102. A heel dome 118A is located on the top surface of insole 100 and a metatarsal dome 134 raised on the top surface of insole 100, each of which respectively improves the cushioning characteristics of the insole at or near high impact points on the insole 100. The medial side of the base layer 102, the heel cup 104, and the lateral side of the base layer 102 are shown in FIG. 3. The teardrop metatarsal pad 134 on top side is integrally formed as upwardly-curved indentation from bottom surface of the insole.

On the foot contact surface of the insole 100, the base layer 102 has a raised heel dome 118A and a metatarsal dome 134. The heel dome 118A is positioned under the heel bone to provide additional cushioning to the user's heel while walking or standing. The metatarsal dome 134 is positioned under the heel bone to provide additional cushioning to the user's heel while walking or standing. The heel dome 118A curves upward from the insole 100 top (foot contact) surface to make a dome-like contact surface under the heel of the user and the metatarsal dome 134 curves upward from the insole 100 top (foot contact) surface to make a dome-like contact surface under the metatarsal area of the foot. The heel dome 118A and the metatarsal dome 134 are preferably molded as a cushion separate from the base layer 102 and secured to the top side of the base layer 102 in the heel area 104. The heel dome 118A is covered by the top sheet 128 providing a continuous contact surface to the user's foot on the top (foot contact) surface of the insole. In an alternative embodiment, the heel dome 118A and the metatarsal dome 134 are integrally formed in the material comprising the top side of the base layer 102.

The heel dome 118A and the metatarsal dome 134 are preferably formed of super soft low density polyurethane, but may be formed of polyurethane memory foam, ethylene glycol polyurethane, ethylene vinyl acetate (EVA), pre-blown EVA, polyurethane (PU), thermoplastic rubber (TPR) or other suitable material. Hardness of the heel dome 118A and the metatarsal dome 134 material can range from less than 10 Asker±3 to greater than 30 Asker±3.

The heel dome 118A on the top (foot contact) surface of the insole 100 is located directly above the heel pad 118 in the bottom (shoe contact) surface (shown in FIGS. 1A, 1B and 2) of the base layer 102, and heel dome 118A provides heel cushioning directly under a user's heel bone and also provides shock absorption on the insole bottom from the top surface of the insole 100. A soft metatarsal dome 134 is located on the top (foot contact) surface providing cushioning directly over the metatarsal area of the foot.

The top sheet 128 is shown in FIG. 3. The top sheet 128 covers the entire foot contact surface of the insole 100 which is treated with an antimicrobial agent. The top surface of the insole 100 is covered by a top sheet 128 that extend across the top surface from heel to toe end. Top sheet 128 is typically made of a non-woven fabric layer with a low coefficient of friction so as to minimize the possibility of blisters, or preferably, top sheet 128 is made of a cooling fabric which contains a special low temperature jade obtained from a natural source. The top sheet can be made of 65% Nylon/35% polyester.

Figure 4:
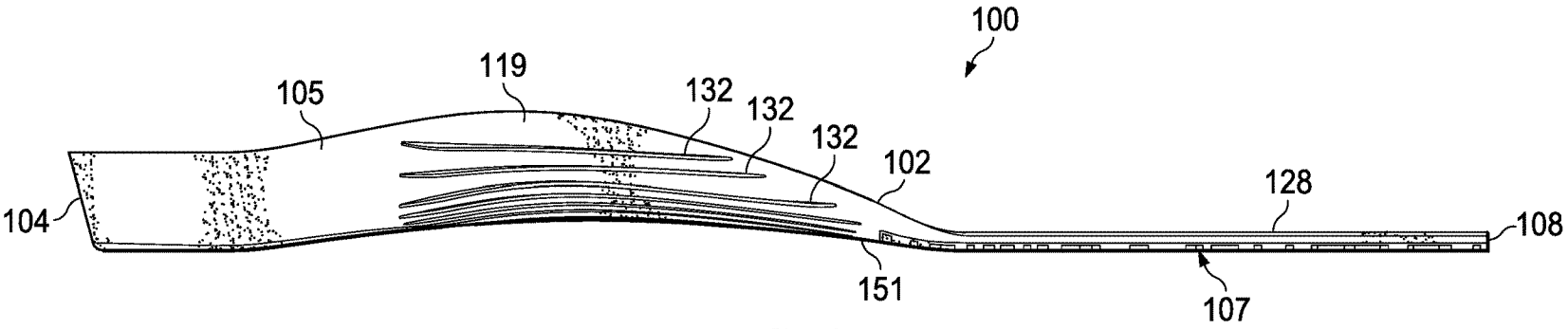
FIG. 4 is a medial (inner arch area) side view of the insole.

Referring to FIG. 4, the medial side view of the insole 100 is shown with curvilinear indentations 132 shown in the raised arch area 119. Also illustrated is a forefoot pad 107 located in the forefoot area 108, a base layer 102, a support cushion 105, the heel cup 104, and a top sheet 128. Insole 100 preferably comprises a top sheet 128 and a base layer 102 having a top surface secured to said top sheet and an opposite bottom surface. Base layer 102 also defines a raised arch support 119 that extends upwardly along the medial side of the insole to provide extra cushion and support to the raised arch 119 of the foot.

Figure 5:
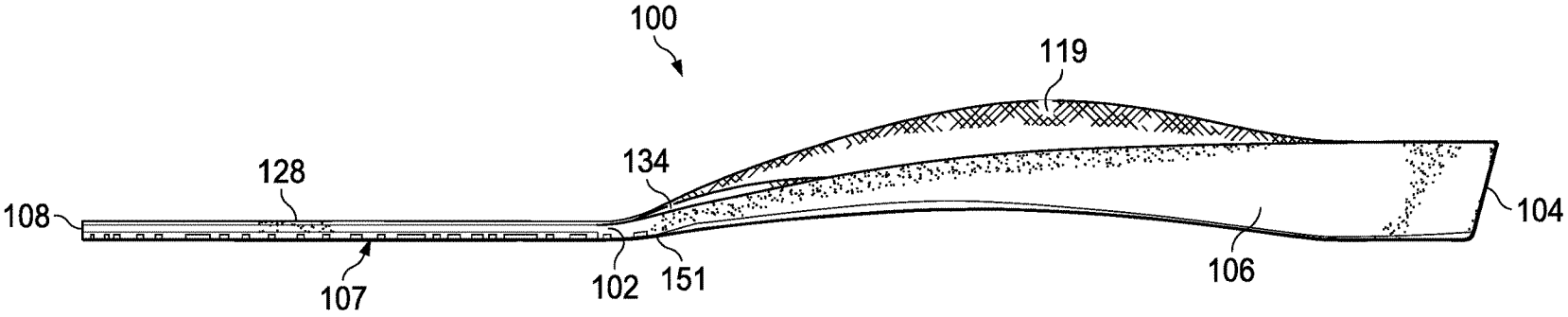
FIG. 5 is a lateral (outer) side view of the insole.

Referring to FIG. 5, the insole 100 lateral side view is shown with the raised arch 119, the metatarsal dome 134, a forefoot pad 107 located in the forefoot area 108, a base layer 102, the heel cup 104, the lateral side 106 of the support cushion 105, and a top sheet 128. FIG. 5 shows insole 100 preferably comprises a top sheet 128 and a base 102 having a top surface secured to said top sheet 128 and an opposite bottom surface. Base layer 102 also defines a raised arch support 119 that extends upwardly along the medial side of the insole to provide extra cushion and support to the arch area of the foot.

As shown in FIGS. 4 and 5, the shoe insole 100 has a bottom surface formed of three pieces including: (1) a base layer 102 extending from heel-to-toe, (2) a forefoot pad 107 positioned in a forefoot pad indentation area 102A (shown in FIG. 1B) on a forefoot base area 108 of the insole 100, and, (3) a midfoot-to-heel support cushion 105 positioned in a midfoot to heel indentation area 102B (shown in FIG. 1B). The three-piece bottom surface construction makes fabrication easier than known methods, and allows for different combinations of materials and cushioning characteristics and support by adjusting the materials used in the forefoot pad 107, base layer 102, the support cushion 105, and the heel pad 118 (shown in FIGS. 1A, 1B and 2).

The forefoot pad 107 extends from the toe end of the insole to the lateral midfoot area and from the medial side to the lateral side of the forefoot area with a diamond-cube pattern molded in the gel having pattern spacing of about 1 mm and a depth of about 1.5 mm. The firmness of the forefoot pad 107 can be adjusted to address issues of over/under pronation, over/under supination, and other problems related to foot motion by altering the size, shape, and material properties of the pads. The configuration, material and position of the forefoot pad 107 provides cushioning and works in association with other items to stabilize the ankle. The forefoot pad 107 has a diamond cube pattern 117 on its bottom surface (shown in FIGS. 1A, 1B and 2) to improve forefoot cushioning characteristics, which improves traction and adhesion of the insole inside and along the interior bottom surface of the user's shoe and improves durability and cushioning aspects of the forefoot pad 107 over known materials.

The midfoot/heel support cushion 105 has a raised arch 119 in the medial arch area, which has longitudinal curvilinear indentations 132 positioned along at least two or more major angles from the longitudinal axis, with the longitudinal axis extending from heel-to-toe on the insole 100. As shown in FIG. 4, longitudinal curvilinear indentations 132 extend in a first angled direction compared to the longitudinal axis of the insole 100. The longitudinal curvilinear indentations 132 in the raised arch 119 provide additional rigidity to the raised arch support 119, which improves support provided by the raised arch 119 on the support cushion 105. These indentations 132 in this formation also promote polyurethane material flow in support cushion 105 formation while assisting to minimize voids caused by air entrapment. The curvilinear indentations 132 in the arch area 119 also allow the arch area to collapse to fit the shoe thus providing a more accommodative design.

There is a raised separation wall 151 shown in FIGS. 4 and 5 located on the base layer 102 between the forefoot pad 107 and the midfoot-to-heel support cushion 105, which is located laterally across the width of the insole 100 between the metatarsal and forefoot areas on the insole 100. The separation wall 151 provides isolation of the forefoot pad 107 from the midfoot-to-heel support cushion 105, which improves the cushioning characteristics of those materials as well as improving the support of the insole 100. At the beginning of the propulsion or toe off phase of a step, the heel begins to lift from the ground and weight shifts to the ball of the foot. Forefoot pad 107 is located under this part of the foot.

The top sheet 128 bottom surface is secured to base layer 102 top surface and a top sheet upper surface which contacts the foot of a user during use. The top sheet 128 is oriented to engage the user's foot on the top surface of the insole, and it serves an upper cooling and ventilation function, and the top sheet 128 can be made of suitable materials, such as a jadeite top cloth material. Preferably, the top sheet 128 is made of a low-friction fabric which prevents blisters on the user's foot. The top sheet 128 may also contain an antimicrobial treatment in order to keep bacteria from multiplying and therefore reduce odor.

Figure 6:
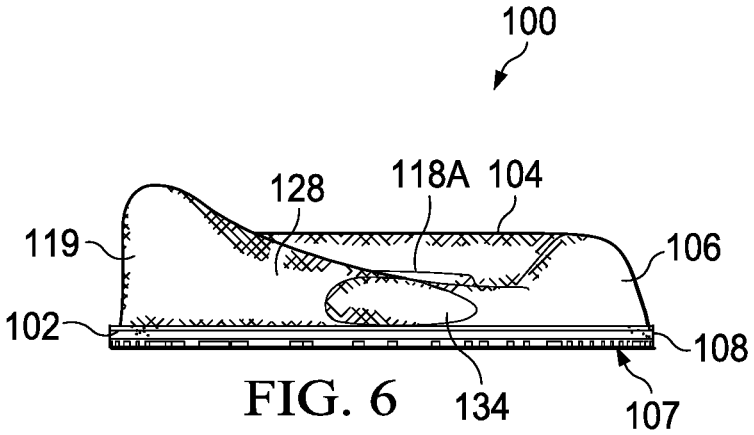
FIG. 6 is front (proximal) view of the insole.
Figure 7:
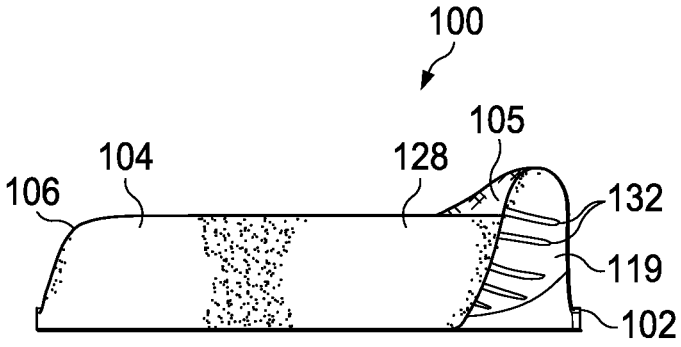
FIG. 7 is a rear (proximal) view of the insole.

Now referring to FIG. 6, the front end view of insole 100 is shown from the front toe end looking toward the heel end 104 with the upraised heel area visible at the heel end 104 and raised arch support 119 shown in FIG. 6. FIG. 6 shows forefoot pad 107 in forefoot area 108, base layer 102, raised arch area 119, and top sheet 128. FIG. 7 shows the heel end view of the insole 100 looking from the heel area towards the toe area, with the top sheet 128 shown in this figure. From this view, one can see the features of insole 100 including heel cup 104, lateral side and medial side of the base layer 102, the raised arch 119 with placement of curvilinear indentations 132, and the top sheet 128.

As shown in FIGS. 6 and 7, the shoe insole 100 has a bottom surface formed of three pieces including: (1) a base layer 102 extending from heel-to-toe, (2) a forefoot pad layer 107 positioned in a forefoot pad indentation 102A (shown in FIG. 1B) on a forefoot base area 108 of the insole 100, and, (3) a midfoot-to-heel support cushion 105 positioned in a midfoot to heel indentation 102B (shown in FIG. 1B). The three-piece bottom surface construction makes fabrication easier than known methods, and allows for different combinations of materials and cushioning characteristics and support by adjusting the materials used in the forefoot pad 107, base layer 102, the support cushion 105, and the heel pad 118 (shown in FIGS. 1A, 1B and 2).

In a preferred embodiment, the insole 100 has a base layer 102, a forefoot pad 107, a heel pad surrounded by a flat midfoot/heel surface and cupped along the back by a heel cup 104. The midfoot/heel cushion 105 has a raised arch 119 in the medial arch area and longitudinal curvilinear indentations 132 positioned along at least two or more major angles from the longitudinal axis, with the longitudinal axis extending from heel-to-toe on the insole 100. A teardrop metatarsal dome 134 shown in FIGS. 6 and is located on top side of the insole 100 is integrally formed from the upwardly-curved metatarsal raised area 134 on the bottom surface, and a diamond cube pattern 117, 120 (shown in FIGS. 1A, 1B and 2) is located on the bottom surface of the forefoot pad 107. A separation wall 151 (shown in FIGS. 1A, 1B and 2) is located between cushion 105 and forefoot pad 107 with an approximate height of 1 mm.

The forefoot pad 107 extends from the toe end of the insole to the midfoot area and extends from the medial side to the lateral side of the forefoot area with a diamond-cube groove pattern molded in the gel having pattern spacing of about 1 mm and a depth of about 1.5 mm. The forefoot pad 107 has a firmness that can be adjusted to address issues of over/under pronation, over/under supination, and other problems related to foot motion by altering the size, shape, and material properties of the pads. The configuration, material and position of the forefoot pad 107 provides cushioning and works in association with other items to stabilize the ankle. The forefoot pad 107 has a diamond shaped groove pattern 117 (shown in FIGS. 1A, 1B and 2) on its bottom surface to improve forefoot cushioning characteristics, which improves traction and adhesion of the insole inside and along the interior bottom surface of the user's shoe and improves durability and cushioning aspects of the forefoot pad 107 over known materials.

The midfoot/heel cushion 105 has a raised arch 119 in the medial arch area of the insole 100 and longitudinal curvilinear indentations 132 positioned along at least one major angle of inclination from the longitudinal axis, with the longitudinal axis extending from heel-to-toe on the insole 100. As shown in FIG. 7, longitudinal curvilinear indentations 132 extend in a first angled direction compared to the longitudinal axis of the insole 100.

The top sheet 128 bottom surface is secured to base layer 102 top surface and a top sheet upper surface which contacts the foot of a user during use. The top sheet 128 is oriented to engage the user's foot on the top surface of the insole, and it serves an upper cooling and ventilation function, and the top sheet 128 can be made of suitable materials, such as a jadeite top cloth material. Preferably, the top sheet 128 is made of a low-friction fabric which prevents blisters on the user's foot. The top sheet 128 may also contain an antimicrobial treatment in order to keep bacteria from multiplying and therefore reduce odor.

Foot contact with the ground is generally divided into three phases: heel strike, midfoot support, and toe off. During heel strike, the heel of the foot impacts the ground with significant force. Following the initial impact of the heel with the ground, the foot twists, or pronates, bringing the medial side of the heel into contact with the ground. The foot is sensitive to the amount of pronation as well as the rate at which the pronation occurs. Pronation is natural, and some degree of pronation is desirable because it serves to absorb the stresses and forces on the foot during walking or running. However, an excessive amount or rate of pronation can result in injury.

All of the above components work in conjunction with each other to accomplish the goals of the invention, such as: (1) improving ankle and foot stability, (2) cushioning the heel and forefoot during push-offs and landings, (3) helping prevent over pronation and over supination conditions, and (4) providing enhanced cushioning features to the heel, midfoot, arch and forefoot areas. Support cushion 105 provides firm support along the medial portion of the foot, including the medial arch area and surrounding the heel area, to help control the amount of foot pronation.

In a first preferred embodiment of the present invention, the various components of an insole which are secured to base layer 102 in the indentation areas defined by base layer 102 on the bottom surface are permanently affixed to base layer 102 using an appropriate means such as an adhesive. The components are secured during the molding process using techniques known in the art of molding insoles. The indentation areas are also lined with a cloth having a base surface and a pad surface, secured to said base layer 102 along said base surface and said pad along said pad surface. Alternatively, a cloth is secured to said pad and then the composite structure secured to the indentation area.

An improved insole 100 has been disclosed. It will be readily apparent that the illustrative embodiments of an insole thus disclosed may be useful in cushioning the foot and controlling pronation during activities such as hiking, backpacking, and the like. However, one will understand that the components of the insole system may be modified to accommodate other activities or to control other kinds of foot motion. Thus, the description provided herein, including the presentation of specific thicknesses, materials, and properties of the insole components, is provided for purposes of illustration only and not of limitation, and that the invention is limited only by the appended claims.

The invention claimed is:

1. A contoured insole used inside a shoe and having a top side that contacts the users foot, a bottom side that contacts the interior of a shoe after insertion therein, a lateral side that lies adjacent to the outer side of a user's foot in use and a medial side that lies adjacent the inner side, or arch, of a user's foot, said insole comprising:

a base layer having a contoured shape which receives and supports the foot of the user, a heel end, a toe end, a top surface, a bottom surface, a lateral side and a medial side, said lateral and medial sides extending approximately from said heel end to said toe end, said base layer having:

(a) a heel dome raised above the top surface of the base layer and located over the heel area of the insole;

(b) a metatarsal dome raised above the top surface of base layer and located over the metatarsal midfoot area of the insole;

(c) a forefoot pad indentation area on the bottom surface of the insole extending from the midfoot to the toe area of the base layer and supporting the insertion of a forefoot pad therein, (d) a midfoot-to-heel stability cushion indentation area on the bottom surface of the insole extending from the midfoot to the heel area of the insole and supporting the insertion of a stability cushion therein;

(e) separation wall on the bottom surface of the base layer and located between said forefoot pad indentation area and said mid-foot-to-heel stability cushion indentation area a stability cushion positioned on the bottom surface of the base layer in the stability cushion indentation area and having:

(a) a raised arch support on the bottom surface of the insole in the medial arch area;

(b) a heel cup on the bottom surface of the insole and surrounding the heel end of the insole with vertical walls, (c) one or more ridges located on the bottom surface of the midfoot area of the stability cushion surrounding a flat surface, (d) a heel pad opening on the bottom surface of the support cushion and surrounded by supporting grooves on the periphery of said heel pad opening; and (e) a metatarsal arch dome raised up from the bottom surface of the insole, said raised arch support having a first set of curvilinear indentations on the bottom surface of the insole in medial arch area and extending generally lengthwise in a longitudinal toe-to-heel direction at a first angle of inclination from the longitudinal axis of the insole;

a forefoot pad positioned on the bottom surface of the insole in the forefoot indentation area;

a heel pad positioned in the heel pad opening of the stability cushion, and extending through the stability cushion to be secured to the bottom surface of the base layer;

a top sheet that extends across the top surface of the base layer from the heel end to the toe end of the insole.

2. The insole of claim 1, wherein said first angle of inclination is between 5-65 degrees compared to said longitudinal axis of said insole.

3. The insole of claim 1, wherein said base layer is made of polyurethane polyester glycol with a hardness 10-30 Asker±3.

4. The insole of claim 1, wherein said forefoot pad made of a clear TPR gel (thermoplastic rubber).

5. The insole of claim 4, wherein said TPR gel has a hardness rating of 10-35 Asker±3.

6. The insole of claim 1, wherein said forefoot pad has a groove pattern with a width spacing of approximately 1.0 mm-1.50 mm.

7. The insole of claim 1, wherein said heel pad is made of pre-blown EVA (ethylene-vinyl acetate) material.

8. The insole of claim 7, wherein said heel pad has a hardness rating of 10-35 Asker±3.

9. The insole of claim 1, wherein said heel pad has a groove pattern with a width spacing of approximately 1.0 mm-1.50 mm.

10. The insole of claim 1, wherein said heel pad aperture is surrounded by a flat mid-foot/heel surface and a heel ridge.

11. The insole of claim 1, wherein base layer is made of a durable nylon fabric.

12. The insole of claim 1, wherein said first curvilinear indentations have a groove depth of approximately 0.50 mm-1.5 mm.

13. The insole of claim 1, wherein said top sheet is made of 65% Nylon/35% polyester.

14. The insole of claim 1, wherein said metatarsal dome on the top side of the insole matches the upwardly-curved metatarsal arch dome on the bottom surface of the insole.

15. The insole of claim 1, wherein said separation wall located on the bottom surface of the base layer and is approximately 1 mm in height.

16. The insole of claim 1, wherein said forefoot and heel pads are made of rubber or synthetic rubber.

17. The insole of claim 1, wherein said forefoot and heel pads are made of a neoprene synthetic rubber.

18. A contoured insole used inside a shoe and having a top side that contacts the users foot, a bottom side that contacts the interior of a shoe after insertion therein, a lateral side that lies adjacent to the outer side of a user's foot in use and a medial side that lies adjacent the inner side, or arch, of a user's foot, said insole comprising:

a base layer having a contoured shape which receives and supports the foot of the user, a heel end, a toe end, a top surface, a bottom surface, a lateral side and a medial side, said lateral and medial sides extending approximately from said heel end to said toe end, said base layer having:

(a) a heel dome raised above the top surface of the base layer and located over the heel area of the insole;

(b) a metatarsal dome raised above the top surface of base layer and located over the metatarsal midfoot area of the insole;

a stability cushion positioned on the bottom surface of the base layer in the stability cushion area and having:

(a) a raised arch support on the bottom surface of the insole in the medial arch area;

(b) a heel cup on the bottom surface of the insole and surrounding the heel end of the insole with vertical walls;

(c) one or more ridges located on the bottom surface of the midfoot area of the stability cushion surrounding a flat surface, (d) a metatarsal arch dome raised up from the bottom surface of the insole; and (e) a heel pad opening on the bottom surface of the base layer in the heel area and surrounded by supporting grooves around its periphery;

said raised arch support having a first set of curvilinear indentations on the bottom surface of the insole in medial arch area and extending generally lengthwise in a longitudinal toe-to-heel direction at a first angle of inclination from the longitudinal axis of the insole;

a forefoot pad positioned on the bottom surface of the insole in the forefoot area;

a heel pad positioned in the heel pad opening of the stability cushion, and extending through the stability cushion to be secured to the bottom surface of the base layer;

a top sheet that extends across the top surface of the base layer from the heel end to the toe end of the insole.

19. The insole of claim 18, wherein said base layer has separation wall on the bottom surface of the base layer and located between said forefoot pad indentation area and said mid-foot-to-heel stability cushion indentation area.

20. The insole of claim 19, wherein said separation wall located on the bottom surface of the base layer and is approximately 1 mm in height.

21. The insole of claim 18, wherein said base layer has a heel dome on the top surface of the base layer and raised over the heel area of the insole.

22. The insole of claim 18, wherein said base layer has a metatarsal dome on the top surface of base layer and raised over the metatarsal midfoot area of the insole.

23. The insole of claim 18, wherein base layer is made of a durable nylon fabric.

24. The insole of claim 18, wherein said first angle of inclination is between 5-65 degrees compared to said longitudinal axis of said insole.

25. The insole of claim 18, wherein said base layer is made of polyurethane polyester glycol with a hardness 10-30 Asker±3.

26. The insole of claim 18, wherein said forefoot pad is made of clear TPR gel (thermoplastic rubber) gel.

27. The insole of claim 26, wherein said TPR gel has a hardness rating of 10-35 Asker±3.

28. The insole of claim 18, wherein said forefoot pad has a groove pattern with a width spacing of approximately 1.0 mm-1.50 mm.

29. The insole of claim 18, wherein said heel pad made of pre-blown EVA (ethylene-vinyl acetate) material.

30. The insole of claim 29, wherein said heel pad has a hardness rating of 10-35 Asker±3.

31. The insole of claim 18, wherein said heel pad has a groove pattern with a width spacing of approximately 1.0 mm-1.50 mm.

32. The insole of claim 18, wherein said heel pad aperture is surrounded by a flat mid-foot/heel surface and a heel ridge.

33. The insole of claim 18, wherein said first curvilinear indentations have a groove depth of approximately 0.50 mm-1.5 mm.

34. The insole of claim 18, wherein said top sheet is made of 65% Nylon/35% polyester.

35. The insole of claim 18, wherein said metatarsal dome on the top side of the insole matches the upwardly-curved metatarsal arch dome on the bottom surface of the insole.

36. The insole of claim 18, wherein said forefoot and heel pads are made of rubber or synthetic rubber.

37. The insole of claim 18, wherein said forefoot and heel pads are made of a neoprene synthetic rubber layer which is a polymer.

38. A method of making a contoured insole to be used inside a shoe and having a top side that contacts the users foot, a bottom side that contacts the interior of a shoe after insertion therein, a lateral side that lies adjacent to the outer side of a user's foot in use and a medial side that lies adjacent the inner side, or arch, of a user's foot, said insole comprising:

providing a base layer with a contoured shape which receives and supports the foot of the user, said base layer having a heel end, a toe end, a top surface, a bottom surface, a lateral side and a medial side, said lateral and medial sides extending approximately from said heel end to said toe end, and said base layer having:

(a) a heel dome raised above the top surface of the base layer and located over the heel area of the insole;

(b) a metatarsal dome raised above the top surface of base layer and located over the metatarsal midfoot area of the insole;

(c) a forefoot pad indentation area on the bottom surface of the insole extending from the midfoot to the toe area of the base layer and supporting the insertion of a forefoot pad therein, (d) a midfoot-to-heel stability cushion indentation area on the bottom surface of the insole extending from the midfoot to the heel area of the insole and supporting the insertion of a stability cushion therein;

(e) separation wall on the bottom surface of the base layer and located between said forefoot pad indentation area and said mid-foot-to-heel stability cushion indentation area positioning a stability cushion on the bottom surface of the base layer in the stability cushion indentation area, said stability cushion having:

(a) a raised arch support on the bottom surface of the insole in the medial arch area;

(b) a heel cup on the bottom surface of the insole and surrounding the heel end of the insole with vertical walls;

(c) one or more ridges located on the bottom surface of the midfoot area of the stability cushion surrounding a flat surface, (d) a metatarsal arch dome raised up from the bottom surface of the insole; and (e) a heel pad opening on the bottom surface of the base layer in the heel area and surrounded by supporting grooves around its periphery;

said raised arch support having a first set of curvilinear indentations on the bottom surface of the insole in medial arch area and extending generally lengthwise in a longitudinal toe-to-heel direction at a first angle of inclination from the longitudinal axis of the insole;

positioning a forefoot pad on the bottom surface of the insole in the forefoot indentation area;

positioning a heel pad in the heel pad opening of the stability cushion, and extending the heel pad through the stability cushion to be secured to the bottom surface of the base layer; and, placing a top sheet that extends across the top surface of the base layer from the heel end to the toe end of the insole.

39. The method of making the insole of claim 38, wherein said first angle of inclination is between 5-65 degrees compared to said longitudinal axis of said insole.

40. The method of making the insole of claim 38, wherein said base layer is made of polyurethane polyester glycol with a hardness 10-30 Asker±3.

41. The method of making the insole of claim 38, wherein said forefoot pad made of a clear TPR gel (thermoplastic rubber).

42. The method of making the insole of claim 41, wherein said TPR gel has a hardness rating of 10-35 Asker±3.

43. The method of making the insole of claim 38, wherein said forefoot pad has a groove pattern with a width spacing of approximately 1.0 mm-1.50 mm.

44. The method of making the insole of claim 38, wherein said heel pad is made of pre-blown EVA (ethylene-vinyl acetate) material.

45. The method of making the insole of claim 44, wherein said heel pad has a hardness rating of 10-35 Asker±3.

46. The method of making the insole of claim 38, wherein said heel pad has a groove pattern with a width spacing of approximately 1.0 mm-1.50 mm.

47. The method of making the insole of claim 38, wherein said heel pad aperture is surrounded by a flat mid-foot/heel surface and a heel ridge.

48. The method of making the insole of claim 38, wherein base layer is made of a durable nylon fabric.

49. The method of making the insole of claim 38, wherein said first curvilinear indentations have a groove depth of approximately 0.50 mm-1.5 mm.

50. The method of making the insole of claim 38, wherein said top sheet is made of 65% Nylon/35% polyester.

51. The method of making the insole of claim 38, wherein said metatarsal dome on the top side of the insole matches the upwardly-curved metatarsal arch dome on the bottom surface of the insole.

52. The method of making the insole of claim 38, wherein said separation wall located on the bottom surface of the base layer and is approximately 1 mm in height.

53. The method of making the insole of claim 38, wherein said forefoot and heel pads are made of rubber or synthetic rubber.

54. The method of making the insole of claim 38, wherein said forefoot and heel pads are made of a neoprene synthetic rubber.

55. The method of making the insole of claim 38 wherein said steps of positioning include forming the material by molding in place.

* * * * *